US010995577B2

(12) United States Patent
Stangherlin et al.

(10) Patent No.: US 10,995,577 B2
(45) Date of Patent: May 4, 2021

(54) METHOD AND SYSTEM FOR CONTROLLING GAS FLOW

(71) Applicant: AUSTRALIAN RIG CONSTRUCTION HOLDINGS PTY LTD, Toowoomba (AU)

(72) Inventors: Guido Stangherlin, Toowoomba (AU); Eugene Murphy, Houston, TX (US)

(73) Assignee: Well Equipment Solutions Holdings Pty Ltd, Wellcamp (AU)

( * ) Notice: Subject to any disclaimer, the term of this patent is extended or adjusted under 35 U.S.C. 154(b) by 511 days.

(21) Appl. No.: 15/573,851

(22) PCT Filed: Sep. 1, 2015

(86) PCT No.: PCT/AU2015/050512
§ 371 (c)(1),
(2) Date: Nov. 14, 2017

(87) PCT Pub. No.: WO2016/179628
PCT Pub. Date: Nov. 17, 2016

(65) Prior Publication Data

US 2018/0258729 A1 Sep. 13, 2018

(30) Foreign Application Priority Data

May 14, 2015 (AU) ..... 2015901757

(51) Int. Cl.
*E21B 33/06* (2006.01)
*E21B 35/00* (2006.01)
(Continued)

(52) U.S. Cl.
CPC ..... *E21B 33/06* (2013.01); *E21B 33/03* (2013.01); *E21B 35/00* (2013.01); *E21B 41/005* (2013.01); *E21B 43/121* (2013.01)

(58) Field of Classification Search
CPC ..... E21B 33/00
See application file for complete search history.

(56) References Cited

U.S. PATENT DOCUMENTS 7,156,193 B2 1/2007 Swartout
2003/0106694 A1 6/2003 Wiseman
(Continued)

FOREIGN PATENT DOCUMENTS

CN 101338654 A 1/2009
CN 201241652 Y 5/2009
(Continued)

OTHER PUBLICATIONS

International Preliminary Report on Patentability issued by the International Bureau of WIPO (Form PCT/IB/373) dated Nov. 14, 2017 for related International application No. PCT/AU2015/050512.

(Continued)

*Primary Examiner* — William D Hutton, Jr.
*Assistant Examiner* — Avi T Skaist
(74) *Attorney, Agent, or Firm* — Enshan Hong; VLP Law Group LLP

(57) ABSTRACT

A well system and method including applying suction to a wellhead housing outlet (8) to divert the flow of subterranean gas from flowing through a gas conduit through the wellhead housing (4). An operation can then safely be performed on a component (e.g. removing a hanger) of the wellhead apparatus. Well gas can be diverted to a flare system (200). Suction can be applied by a venturi system including eductors (104, 106). The method may include opening the gas conduit outlet once a pressure sensed at the conduit outlet is negative. Suction may also be applied to an upper outlet (14).

18 Claims, 15 Drawing Sheets

(51) Int. Cl.

| | |
|---|---|
| ***E21B 41/00*** | (2006.01) |
| ***E21B 33/03*** | (2006.01) |
| *E21B 43/12* | (2006.01) |

(56) References Cited

U.S. PATENT DOCUMENTS

| | | | | |
|---|---|---|---|---|
| 2007/0107910 | A1 | 5/2007 | McGuire et al. | |
| 2008/0029269 | A1* | 2/2008 | Martin, Jr. ..... | E21B 33/0355 166/335 |
| 2009/0032241 | A1 | 2/2009 | Allen | |
| 2014/0166267 | A1 | 6/2014 | Weightman et al. | |
| 2015/0021018 | A1* | 1/2015 | Tunget ..... | E21B 41/0007 166/250.01 |

FOREIGN PATENT DOCUMENTS

| | | | |
|---|---|---|---|
| EP | 2236739 | A2 | 10/2010 |
| WO | 2006/032850 | A1 | 3/2006 |
| WO | 2011061502 | A2 | 5/2011 |

OTHER PUBLICATIONS

Extended European Search Report dated Nov. 28, 2018 by European Patent Office in connection with related European Patent Application No. 15891418.4.

* cited by examiner

METHOD AND SYSTEM FOR CONTROLLING GAS FLOW

PRIORITY CLAIM

This is a U.S. national stage of application No. PCT/AU2015/050512, filed on Sep. 1, 2015. Priority is claimed on the following applications: Country: Australia, Application No.: 2015901757, Filed: May 14, 2015, the content of which is incorporated here by reference.

TECHNICAL FIELD

The present invention relates to a method and a system for controlling the flow of gas from an oil or gas well.

BACKGROUND ART

Operations on oil and gas wells need to be performed at regular intervals. Such well operations may include operations at or adjacent a wellhead, in which it may be necessary to remove or replace components of the wellhead (such as a hanger), equipment mounted relative to the wellhead such as the blowout preventer (BOP), or to complete the well. In many of these well operations, it is necessary to open the conduit between the well bore and the atmosphere. To safely open this conduit the flow of gas out of the well must be controlled (especially for gas wells), otherwise maintenance operations would be performed in the presence of a flammable gas which would be extremely dangerous. To the inventor's knowledge the only previous viable method for controlling the gas flowing out of an open well is to kill the well.

Typically, oil and gas wells are killed by filling the well with fluid (especially water). In this process, the hydrostatic pressure of the fluid in the well counteracts the downhole pressure of the gas or oil, which prevents flammable gas from escaping from the well bore to the atmosphere. After the well operation is complete, the fluid is pumped out of the well and the well is ready for re-use. However, this process has many disadvantages.

First, it takes time to fill a well with fluid, and time to pump the fluid out of the well after the well operation is complete. Financially, it is best for a well to be non-operational for the shortest possible time.

Secondly, rock surrounding the well bore may be porous to water (i.e. an aquifer) or non-porous to water (i.e. an aquitard). If aquifers are present, then after the well bore is filled with fluid, the fluid may drain through the aquifers. Consequently, it is necessary to monitor the fluid levels in the killed well, and to top up the fluid in the well when necessary. In some cases, fluid may drain through aquifers to the extent that the well cannot be killed. In general, a well becomes harder to kill over time.

Thirdly, fluids such as water may interact with subsurface earth and rocks and affect the structure of the well formation. For example, some clays will swell in the presence of water which can alter the structure of the formation. Water can also dissolve rocks/soils in the formation, possibly resulting in collapse of some structures within the formation or other adverse effects.

Fourthly, when an operator seeks to pump fluid out of the well it may not be possible to pump all fluid out of the well. The fluid left down the well after the well operation is complete may block or impede the flow of gases (for example) from the well when the well is again in use.

Fifthly, it can be necessary to pump large volumes of fluid into a well to kill the well. After this fluid is pumped out, it generally must be treated before disposal. This treatment step incurs costs.

Sixthly, the introduction of fluid into a well can stimulate microbial growth, contributing to biofouling within the well.

SUMMARY OF INVENTION

The present invention is directed to, inter alia, a method and a system for controlling the flow of gas from an oil or gas well that overcomes or ameliorates one or more of the abovementioned disadvantages or provide the consumer with a useful or commercial choice.

In a first aspect, the present invention provides a method of controlling the flow of gas within a wellhead housing in gaseous communication with subterranean gas exiting a well bore, wherein the wellhead housing includes a first gas conduit and at least one wellhead housing outlet, wherein the first gas conduit has a first end in gaseous communication with the subterranean gas exiting the well bore and a second end distal the first end, and wherein the at least one wellhead housing outlet is in gaseous communication with the first gas conduit intermediate said first and second ends, the method including the step of:

applying suction to the at least one wellhead housing outlet to divert the flow of subterranean gas within the first gas conduit to the at least one wellhead housing outlet to thereby control the flow of gas within the wellhead housing.

In one embodiment of the first aspect, the step of applying suction to the at least one wellhead housing outlet to divert the flow of subterranean gas within the first gas conduit to the at least one wellhead housing outlet and thereby control the flow of gas within the wellhead housing is a step of applying suction to the at least one wellhead housing outlet to control the flow of gas within the first gas conduit and thereby within the wellhead housing.

As used herein, the term "divert" may mean that all, substantially all, or greater than 95%, 90%, 85%, 80%, 70%, 60% or 50% or greater than 25% of the subterranean gas within the first gas conduit is diverted to the at least one wellhead housing outlet. The step of applying suction to the at least one wellhead housing outlet may divert the flow of subterranean gas within the first gas conduit away from the wellhead housing first gas conduit second end. In another embodiment, the step of applying suction to the at least one wellhead housing outlet may result in no, substantially no, or less than 5%, 10%, 15%, 20%, 30%, 40%, 50% or 75% subterranean gas exiting to the atmosphere via the first gas conduit second end.

In a second aspect, the present invention provides a well system including:

a wellhead housing in gaseous communication with subterranean gas exiting a well bore, wherein the wellhead housing includes a first gas conduit and at least one wellhead housing outlet, wherein the first gas conduit has a first end in gaseous communication with the subterranean gas exiting the well bore and a second end distal the first end, and wherein the at least one wellhead housing outlet is in gaseous communication with the first gas conduit intermediate said first and second ends; and a suction source in gaseous communication with the at least one wellhead housing outlet for applying suction to the at least one wellhead housing outlet to divert the flow of subterranean gas within the first gas conduit to the at least one wellhead housing outlet.

In one embodiment of the second aspect, the suction source for applying suction to the at least one wellhead housing outlet to divert the flow of subterranean gas within the first gas conduit to the at least one wellhead housing outlet is a suction source for applying suction to the at least one wellhead housing outlet to control the flow of gas within the first gas conduit and thereby within the wellhead housing. The suction source may divert the flow of subterranean gas within the first gas conduit away from the first gas conduit second end. In one embodiment, no, substantially no, or less than 5%, 10%, 15%, 20%, 30%, 40%, 50% or 75% subterranean gas exits to the atmosphere via the first gas conduit second end.

Advantageously, by applying suction to the at least one wellhead housing outlet the flow of gas within the wellhead housing may be diverted away from the first gas conduit second end. In this way, it may be possible to direct substantially all subterranean gas from a well bore through the at least one wellhead housing outlet, which in turn permits well operations to be safely performed above the wellhead housing (or beyond the first gas conduit second end) without killing the well or sealing the first gas conduit.

The ability to control the flow of gas within the wellhead housing without killing the well provides numerous advantages. For example, the flow of subterranean gas from the well bore may be controlled by the present invention in a shorter timeframe than is required to kill a well by filling a well with fluid, and the subterranean gas flow may be reinstated in a shorter timeframe than is required to pump fluid out of a well. In total, this can reduce the time needed to perform a well operation by as much as (or greater than) 80%. Furthermore, by employing the system and methods as hereindescribed, the cost to perform a well operation may be reduced by at least 50%.

Furthermore, as the flow of gas within the wellhead housing may be controlled without filling the well with fluid, the structure of the well formation would be unaffected by the present invention as would the growth of microorganisms within the well formation. The flow rate of subterranean gas through the well bore also would be unaffected by use of the present invention to control the flow of gas within the wellhead housing. Advantageously, the present invention may also be used even for wells that cannot be killed by filling the well with fluid.

Features of the first and second aspects of the present invention may be as described below.

The flow of gas controlled within the wellhead housing may include subterranean gas entering the wellhead housing from the well bore (said subterranean gas may be emitted from a subterranean gas source), and optionally also gas entering the wellhead housing from the atmosphere (for example through the first gas conduit second end). The subterranean gas may be, for example, from a coal seam gas well or an oil well.

Wellheads are known to persons skilled in the art, and wellheads typically include a hanger and a wellhead housing. The hanger is typically removable from the wellhead housing, and tubing strings may optionally extend from the hanger into the well bore for collection of subterranean gas or oil. As used herein, the term "wellhead housing" refers to the portion of the wellhead that connects to the well bore. In particular, the wellhead housing may connect to the casing strings lining the well bore. The wellhead housing may be integrally formed, or formed from two or more components. The wellhead housing may include one, two or more spools. The wellhead housing may include a mount for a hanger (or a hanger landing position). The mount may be proximate to the wellhead housing first gas conduit second end. The at least one wellhead housing outlet may be positioned intermediate the first gas conduit first end and the mount.

The wellhead housing includes a first gas conduit in gaseous communication with subterranean gas exiting the well bore. The first gas conduit may be open to the atmosphere or closed to the atmosphere, especially open to the atmosphere. The first gas conduit second end may be open to the atmosphere. The wellhead housing may be substantially in the form of an annulus, defining a central bore. The first gas conduit may be provided by the central bore. The first gas conduit may have a longitudinal axis coaxial with the longitudinal axis of the well bore. The first gas conduit may be in register with the well bore. The first gas conduit may be of any suitable diameter.

The at least one wellhead housing outlet may include one or a plurality of wellhead housing outlets or gas conduits, more especially one, two, three or four gas conduits, most especially one, two or three gas conduits. In one embodiment, the at least one wellhead housing outlet is a second gas conduit. The at least one wellhead housing outlet may extend from the first gas conduit. The at least one wellhead housing outlet may extend substantially perpendicularly (especially perpendicularly) to the longitudinal axis of the first gas conduit. The at least one wellhead housing outlet may be in register with the first gas conduit. In one embodiment, the first gas conduit first end is in register with the well bore, and the second end is open to the atmosphere or in register with another component of a wellhead apparatus (as defined further below). The at least one wellhead housing outlet may be in register with or extend from the first gas conduit. The or each of the at least one wellhead housing outlet may be closeable, for example by a valve (especially an isolation valve).

Each of the at least one wellhead housing outlets may be of any suitable diameter. In some embodiments, each of the at least one wellhead housing outlets (or the second gas conduit) has a diameter of from 0.5 to 10 inches; especially from 0.5 to 8 inches, from 1 to 6 inches, from 1 to 5 inches, from 1 to 4 inches or from 1 to 3 inches; most especially about 2 inches. Each of the at least one wellhead housing outlets may have a smaller diameter than the first gas conduit. In one embodiment, one or two outlets of the at least one wellhead housing outlets (or the second gas conduit) may have a diameter of from 0.5 to 10 inches; especially from 0.5 to 8 inches, from 1 to 6 inches, from 1 to 5 inches, from 1 to 4 inches or from 1 to 3 inches; most especially about 2 inches (said one or two gas conduits may be provided by outlets proximate to the first gas conduit first end (or at the base of the wellhead)) In another embodiment, one or two outlets of the at least one wellhead housing outlets may have a diameter of from 0.5 to 10 inches; especially from 1 to 10 inches, from 2 to 8 inches, from 3 to 7 inches or from 4 to 6 inches; most especially about 4 or 6 inches (said one or two gas conduits may be provided by the upper of two components which together form the wellhead housing).

The wellhead housing may form part of a wellhead apparatus (or wellhead stack). The wellhead apparatus may include one or more of: a wellhead housing, a hanger, a blowout preventer (or BOP), a ball valve, a mud cross and at least one spool (including one or more tubing spools, casing spools, and/or eductor spools). A BOP may be connected to the wellhead housing. The BOP may include at least a 2 kspi ram, especially at least a 3 kspi ram, a 4 kpsi ram or a 5 kpsi ram. The BOP may extend from the first gas conduit second end.

The first gas conduit may extend through the wellhead apparatus (excluding the hanger). For the avoidance of doubt, the term "wellhead housing first gas conduit" and the like only refer to the first gas conduit (or portion thereof) that extends through the wellhead housing. In contrast, the term "wellhead apparatus first gas conduit" and the like refers to the first gas conduit that extends through the wellhead apparatus (including the wellhead housing). The wellhead apparatus first gas conduit may include a bottom end in gaseous communication with the subterranean gas exiting the well bore (typically the wellhead housing first end) and a top end distal or opposite the bottom end. Accordingly, the wellhead housing first gas conduit second end may be located within the wellhead apparatus first gas conduit.

In one embodiment, the wellhead housing together with the blowout preventer and/or the at least one spool define a central bore. The blowout preventer and the at least one spool may each be in the form of an annulus, defining a central bore. The wellhead apparatus first gas conduit may be provided by the central bore. The wellhead apparatus may include a bottom end and a top end.

The first gas conduit (in the wellhead housing or in the wellhead apparatus) may be open to the atmosphere. This may occur if, for example, the wellhead apparatus consists of the wellhead housing, or if the wellhead apparatus does not include a wellhead bonnet or Christmas tree valves. For the avoidance of doubt, the wellhead housing first gas conduit second end is open to the atmosphere if (for example) a BOP is in register with the second end, and the first gas conduit is open at the BOP.

The wellhead apparatus may include at least one upper outlet (in which case the "at least one wellhead housing outlet" may be "at least one lower outlet"). The at least one upper outlet may include at least one or a plurality of outlets or gas conduits, more especially one, two, three or four gas conduits, most especially one, two or three gas conduits. In one embodiment, the at least one upper outlet is a third gas conduit. The at least one upper outlet may be in gaseous communication with the wellhead apparatus first gas conduit. The at least one upper outlet may extend from the wellhead apparatus first gas conduit. The at least one upper outlet may extend substantially perpendicularly (especially perpendicularly) to the longitudinal axis of the wellhead apparatus first gas conduit. The at least one upper outlet may extend substantially parallel to the at least one wellhead housing outlet. The at least one upper outlet may be located on the wellhead apparatus distal to the well bore. The at least one upper outlet may be in register with the first gas conduit. The at least one upper outlet may be closeable, for example by a valve (especially an isolation valve). The at least one upper outlet may be positioned intermediate the wellhead apparatus bottom end and top end. The at least one upper outlet may be positioned intermediate the at least one wellhead housing outlet and the wellhead apparatus top end. The mount for a hanger may be positioned intermediate the at least one wellhead housing outlet and the at least one upper outlet. The wellhead apparatus may include at least one spool, and the at least one spool includes the at least one upper outlet. In the first aspect, the method may include the step of applying suction to the at least one upper outlet to thereby divert the flow of subterranean gas within the first gas conduit to the at least one upper outlet to thereby control the flow of gas within the wellhead housing.

In one embodiment of the first aspect, a blowout preventer and at least one spool are in gaseous communication with the wellhead housing, wherein the blowout preventer extends from the first gas conduit second end and is positioned intermediate the at least one spool and the wellhead housing, wherein the blowout preventer, the at least one spool and the wellhead housing define a central bore providing a wellhead apparatus first gas conduit which has a top end opposite the wellhead housing first gas conduit first end, wherein the at least one spool includes at least one upper outlet intermediate the first gas conduit top end and the at least one wellhead housing, and the method includes the step of:

applying suction to the at least one wellhead housing outlet and to the at least one upper outlet to thereby divert the flow of subterranean gas within the first gas conduit to the at least one wellhead housing outlet and the at least one upper outlet to thereby control the flow of gas within the wellhead housing.

The well system may further include a blowout preventer and at least one spool, wherein the blowout preventer extends from the first gas conduit second end and is positioned intermediate the at least one spool and the wellhead housing, wherein the blowout preventer, the at least one spool and the wellhead housing define a central bore providing a wellhead apparatus first gas conduit which has a top end opposite the wellhead housing first gas conduit first end, wherein the at least one spool includes at least one upper outlet intermediate the first gas conduit top end and the at least one wellhead housing, and the well system includes a suction source for applying suction to the at least one upper outlet to divert the flow of subterranean gas within the first gas conduit to the at least one upper outlet.

Each of the at least one upper outlets may be of any suitable diameter. In some embodiments, each outlet of the at least one upper outlet (or the third gas conduit) has a diameter of from 0.5 to 10 inches; especially from 1 to 10 inches, from 2 to 8 inches, from 3 to 8 inches, from 4 to 8 inches or from 5 to 7 inches; most especially about 6 inches.

The wellhead apparatus may include at least one spool, and the at least one spool may include a tubing spool, a casing spool, an eductor spool, a drilling spool and/or a crossover spool (for controlling a pressure differential); especially an eductor spool. The at least one spool may be at least one mud cross. At least one of said spools may include an outlet. The at least one spool may include a transverse outlet. The at least one upper outlet (or the third gas conduit) may be provided by said outlet or transverse outlet (especially by outlets of one or more eductor spools). For the avoidance of doubt, each of said spools may or may not include an outlet. In one embodiment, the at least one of said spools may include at least three entrances/exits. The at least one spool may define a longitudinal conduit extending through the at least one spool, and at least one transverse conduit extending from the longitudinal conduit. The longitudinal conduit may form part of the first gas conduit, and the at least one upper conduit (or the third gas conduit) may be provided by said at least one transverse conduit.

The wellhead apparatus may further include at least one sensor (especially one sensor), especially a pressure sensor or a gas flow rate sensor. The pressure sensor may be for sensing the pressure within the wellhead apparatus. The sensor may be located within or adjacent to the first gas conduit. The sensor may be located distal to the well bore (or to the wellhead housing). The sensor may be a pressure gauge.

A suction source in gaseous communication with the at least one wellhead housing outlet may be for applying suction to the at least one wellhead housing outlet. Any suitable suction source may be used. For example, the suction source may be a gas vacuum pump. However, the subterranean gas is typically flammable, and the gas passing through the first conduit may include gas from the atmosphere (which includes oxygen). Consequently, care needs to be employed in selecting the suction source in order to avoid sparks which may clause an explosion.

The suction source may be for exhausting or evacuating gas from the wellhead housing or wellhead apparatus, especially for evacuating gas. The suction source may be a venturi system including at least one eductor. The venturi system employs the venturi effect. In one embodiment of the first aspect, the suction is applied by a venturi system including at least one eductor.

The venturi system may include at least one eductor, especially one, two, three, four, five or six eductors. The venturi system may include at least one of a first suction system, a second suction system and a third suction system. However, the venturi system need not include the second suction system or the third suction system.

The first suction system may be configured to apply suction to the at least one wellhead housing outlet, or may be configured to control the suction at the at least one wellhead housing outlet. The first suction system may include at least one eductor, especially one or a plurality of eductors, more especially one, two, three, four or five eductors. Said plurality of eductors may be connected in series or in parallel. However, in one embodiment the first suction system may not include an eductor. The first suction system may include at least one valve, especially at least one valve selected from the group consisting of: at least one back pressure valve, at least one ball valve, at least one shut off valve, and at least one choke valve (or choke manifold). The first suction system may include at least one inlet for entry of gas exiting the at least one wellhead housing outlet (typically one inlet for each of the at least one wellhead housing outlets) and at least one outlet for exit of gas (typically one outlet). The or each of the at least one inlet of the first suction system may be in gaseous communication with (or in register with) the or each of the at least one wellhead housing outlets. Each said at least one eductor may be proximate to each said at least one inlet of the first suction system. The first suction system may include at least one pipe or conduit, especially a plurality of pipes. Said pipes may connect at least one of the group consisting of: the at least one inlet, the at least one outlet, at least one valve and the at least one eductor. The at least one pipe may include at least one junction for combining gas flowing from at least two inlets. The first suction system may include a plurality of inlets, and only one outlet.

At least a portion of the first suction system may be configured for use with high pressures (for example, the first suction system at the inlet end may be subjected to high pressures). The first suction system may include a choke valve or choke manifold to control a pressure differential within the system. It may be advantageous for the choke valve or choke manifold to be positioned intermediate the at least one inlet and any eductors in the first suction system (but this need not be the case).

In one embodiment of the first aspect, the step of applying suction to the at least one wellhead housing outlet includes controlling the suction applied to the at least one wellhead housing outlet via the first suction system. In another embodiment of the first aspect, the step of applying suction to the at least one wellhead housing outlet includes applying suction to the at least one wellhead housing outlet via the first suction system.

The second suction system may be configured to apply suction to the at least one upper outlet, or may be configured to control the suction at the at least one upper outlet. The second suction system may include at least one eductor, especially one or a plurality of eductors, more especially one, two, three, four or five eductors. Said plurality of eductors may be connected in series or in parallel. However, in one embodiment the second suction system may not include an eductor. The second suction system may include at least one valve, especially at least one valve selected from the group consisting of: at least one back pressure valve, at least one ball valve, at least one shut off valve, and at least one choke valve (or choke manifold). The second suction system may include at least one inlet for entry of gas exiting the at least one upper outlet (typically one inlet for each of the at least one upper outlets) and at least one outlet for exit of gas (typically one outlet). The or each of the at least one inlet of the second suction system may be in gaseous communication with (or in register with) the or each of the at least one upper outlets. Each said at least one eductor may be proximate to each said at least one inlet of the second suction system. The second suction system may include at least one pipe or conduit, especially a plurality of pipes. Said pipes may connect at least one of the group consisting of: the at least one inlet, the at least one outlet, at least one valve and the at least one eductor. The at least one pipe may include at least one junction for combining gas flowing from at least two inlets. The second suction system may include a plurality of inlets, and only one outlet.

In one embodiment of the first aspect, the step of applying suction to the at least one upper outlet includes controlling the suction applied to the at least one upper outlet via the second suction system. In another embodiment of the first aspect, the step of applying suction to the at least one upper outlet includes applying suction to the at least one upper outlet via the second suction system.

The third suction system may be configured to apply suction to the first and second suction systems, or to transfer gas from the first and second suction systems to (for example) a flare system. The third suction system may include at least one eductor, especially one or a plurality of eductors, more especially one, two, three, four or five eductors. Said plurality of eductors may be connected in series or in parallel. However, in one embodiment the third suction system may not include an eductor. The third suction system may include at least one valve, especially at least one valve selected from the group consisting of: at least one back pressure valve, at least one ball valve, at least one shut off valve, and at least one choke valve (or choke manifold). The third suction system may include at least one inlet for entry of gas exiting the first and second suction systems and at least one outlet for exit of gas (typically one outlet). The at least one inlet of the third suction system may be in gaseous communication with (or in register with) the outlets of the first and second suction systems. The at least one outlet of the third suction system may be in gaseous communication with (or in register with) the inlet of a flare system (as discussed below). Each said at least one eductor may be proximate to each said at least one inlet or said at least one outlet of the third suction system, especially proximate said at least one outlet. It may be efficient to include at least one eductor proximate to the at least one outlet as this assists to "draw" the gas through the venturi system. The third suction system may include at least one pipe or conduit, especially a plurality of pipes. Said pipes may connect at least one of the group consisting of: the at least one inlet, the at least one outlet, at least one valve and the at least one eductor. The at least one pipe may include at least one junction for combining gas flowing from at least two inlets. The third suction system may include a plurality of inlets, and only one outlet.

In one embodiment of the first aspect, the step of applying suction to the at least one wellhead housing outlet and/or the at least one upper outlet includes applying suction to the first and second suction systems via the third suction system. In another embodiment, the step of applying suction to the at least one wellhead housing outlet and/or the at least one upper outlet includes transferring gas from the first and second suction systems using the third suction system, for example to transfer the gas to a flare system.

The venturi system may include at least one inlet and at least one outlet. The at least one inlet of the venturi system may be in gaseous communication with (or in register with) the or each of the at least one wellhead housing outlets and/or the at least one upper outlets. The at least one outlet of the venturi system may be in gaseous communication with (or in register with) at least one flare system (as discussed below).

In one embodiment, the venturi system include a first eductor (especially an eductor in the first suction system) configured to apply suction to the at least one wellhead housing outlet (or the second gas conduit). In another embodiment, the venturi system includes a second eductor (especially an eductor in the second suction system) configured to apply suction to the at least one upper outlet (or the third gas conduit). In yet another embodiment, the venturi system includes a single eductor configured to apply suction to both the at least one wellhead housing outlet and the at least one upper outlet (or to the second and third gas conduits). At least one eductor may be configured to apply suction to at least one of the at least one wellhead housing outlet and the at least one upper outlet (or to the second and/or third gas conduits).

The venturi system may include more than one eductor configured to apply suction to a single gas conduit. For example, two eductors may be configured to apply suction to the at least one wellhead housing outlet and the at least one upper outlet (or to the second gas conduit, or to the third gas conduit). For example, if the outflow of the eductors is to be vented to the atmosphere a long distance from the wellhead apparatus, then use of two eductors (for example, one proximate to the wellhead housing and one distal to the wellhead housing) may assist in providing effective suction at the wellhead apparatus. For example, the first and/or second suction systems may include at least one eductor proximate to the wellhead apparatus, and the third suction system may include at least one eductor proximate to a flare system.

Any suitable eductor may be used in the venturi system, and the eductors may be of any suitable diameter. In one embodiment, at least one of said eductors has a diameter of from 0.5 to 15 inches; especially from 0.5 to 12 inches. At least one eductor in the first suction system (or the first eductor) may have a smaller diameter than at least one eductor in the second suction system (or the second eductor (if present)). The at least one eductor in the first suction system (or the first eductor) may have a diameter of from 0.5 to 5 inches, or from 0.5 to 4 inches; especially from 1 to 3 inches; most especially about 2 inches. The at least one eductor in the second suction system (or the second eductor), or at least one eductor in the third suction system, may have a diameter of from 6 to 15 inches, especially from 8 to 12 inches, most especially from 9 to 11 inches or about 10 inches. Suitable eductors may be sold by Schutte and Koerting and Mathena, Inc. The inventors have advantageously found that the system typically operates more effectively if the at least one eductor is positioned distal to the wellhead (or proximate to the flare system (as discussed further below)).

The venturi system may also include at least one fluid compressor, especially at least one gas compressor, more especially at least one air compressor. In some embodiments, the venturi system includes one, two or three fluid compressors. The at least one fluid compressor may be configured to provide fluid (especially gas) to the at least one eductor to thereby provide a venturi effect. The venturi system may include two or three fluid compressors. The presence of two or three fluid compressors may provide redundancy if the first fluid compressor ceases working. The venturi system may include at least one fluid compressor configured to provide fluid to at least one eductor in the first, second and/or third suction systems. In one embodiment, the venturi system includes at least one fluid compressor for each of the first, second and/or third suction systems. In another embodiment, the venturi system may include a fluid compressor configured to provide fluid to at least one eductor in two or more of the group selected from: the first suction system, the second suction system and the third suction system. The at least one fluid compressor may be capable of providing at least 500 Standard Cubic Feet per Minute (SCFM) of compressed gas (especially compressed air), more especially at least 600 SCFM or at least 700 SCFM, most especially at least 800 SCFM or about 900 SCFM.

The venturi system may also include valves, especially one or more back pressure valves (which may be positioned between the fluid compressor and the eductor), one or more ball valves, and one or more shut off valves. The venturi system may further include at least one choke valve or manifold. It may be advantageous to employ a choke valve or manifold where a pressure differential may be created. For example, the venturi system may include a first choke valve (or first choke manifold) intermediate the first eductor and the second gas conduit (or within the first suction system). The venturi system may also include a second choke valve (or second choke manifold) intermediate the at least one fluid compressor and an eductor (such as the first and/or second eductor, or the at least one eductor of the first, second or third suction systems). Any suitable choke manifold may be used, and a suitable choke manifold may be one commonly used for drilling. If a 3 point connector (such as a "Y" or a "T" shaped connector) is used, especially to apply suction to both the first and second suction systems (or the second and third gas conduits) via an eductor, then the venturi system may include choke valves between the gas conduits and the eductor. The first choke valve (or manifold) may be configured for use with high pressures. The venturi system may include a high pressure line connecting the second gas conduit to the first choke valve (or manifold). The venturi system may also include a low pressure line connecting the first choke valve (or manifold) to the first eductor. Said valves, choke valves or choke manifolds may be present in one or more of the first, second or third suction systems.

The venturi system may include a controller for controlling the choke manifolds and/or valves. The controller may be a programmable logic controller (PLC).

In one embodiment, a line or pipe extending from the first suction system inlet to a choke valve in the first suction system (or from the second gas conduit to the first choke valve) is a high pressure line. The remaining lines or pipes in the venturi system may be low pressure lines. Any suitable diameter for the lines (or pipes) may be used. In one embodiment, the lines (or conduits or pipes) in the venturi system have a diameter of from 1" to 10", more especially from 2" to 8".

The venturi system may further include one or more purges for forcing liquid out of the system. This may be advantageous as the system may operate more effectively if liquid does not enter the system, or is not present or significantly present in the system.

The venturi system may further include at least one sensor, especially a pressure or gas flow rate sensor. The first, second or third suction system may each include at least one sensor. In one embodiment, a first sensor is located at a choke valve in the first suction system or at the first choke valve (or manifold). The first sensor may be a pressure sensor for sensing the pressure at or adjacent to the valve or manifold, or a gas flow rate sensor for sensing the flow rate of gas through the valve or manifold. In another embodiment, a second sensor is located at the second choke valve (or manifold). The second sensor may be a pressure sensor for sensing the pressure at the valve or manifold, or a gas flow rate sensor for sensing the flow rate of gas through the valve or manifold. Any suitable pressure sensor may be used. It may be advantageous to locate a pressure sensor at the valve or manifold, as said pressure sensor may be used to determine when the well is placed under reduced pressure. Said at least one sensor may be for monitoring the pressure at the wellhead housing or wellhead apparatus and/or the pressure within the venturi system (for example pressure within the first, second or third suction systems).

In a first exemplary embodiment, the wellhead apparatus includes a wellhead housing and only a first gas conduit and at least one wellhead housing outlet (or a second gas conduit), and the venturi system includes a first suction system which includes a first eductor configured to apply suction to the at least one wellhead housing outlet (or the second gas conduit). The venturi system may also include at least one fluid compressor configured to provide fluid to the first eductor to thereby provide a venturi effect. A first choke valve or manifold may be positioned between the at least one fluid compressor and the first eductor, and a second choke valve or manifold may be positioned between the first gas conduit and the first eductor. The first eductor may have a single outlet which is in gaseous communication with a flare system (as outlined further below). The outlet of an eductor may be of larger diameter than the inlets.

In a second exemplary embodiment, the wellhead apparatus includes a wellhead housing, a first gas conduit, and at least one wellhead housing outlet and at least one upper outlet (or a second and a third gas conduit). The venturi system may include a first and a second suction system, and the first and second suction systems each include at least one eductor (or one eductor). The venturi system may include a first eductor configured to apply suction to the second gas conduit, and a second eductor configured to apply suction to a third gas conduit. The venturi system may also include at least one fluid compressor configured to provide fluid to the at least one eductors of the first and second suction systems, or to the first and second eductors, to thereby provide a venturi effect. A first choke valve or manifold may be positioned intermediate the at least one fluid compressor and the at least one eductors of the first and second suction systems, and a second choke valve or manifold may be positioned within the first suction system intermediate at least one gas inlet and an eductor. Alternatively, a first choke valve or manifold may be positioned between the at least one fluid compressor and the first and second eductors, and a second choke valve or manifold may be positioned between the second gas conduit and the first eductor. The first and second suction systems, or the first eductor and the second eductor, may each have an outlet which is in gaseous communication with a flare system (as outlined further below).

In a third exemplary embodiment, the wellhead apparatus includes a wellhead housing, a first gas conduit, and at least one wellhead housing outlet and at least one upper outlet (or a second and a third gas conduit), and the venturi system includes a first, second and third suction system. The third suction system includes an eductor, and the first and second suction systems each include valves for controlling the suction at the first and second gas outlets (in this exemplary embodiment the first and second suction systems do not include eductors). The third suction system includes two inlets (one for each of the outlets of the first and second suction systems), and a single outlet. (Alternatively, the venturi system may include a first eductor configured to apply suction to the second and the third gas conduit). The venturi system may also include at least one fluid compressor configured to provide fluid to the eductor to thereby provide a venturi effect. A first choke valve or manifold may be positioned in the third suction system (or between the at least one fluid compressor and the first eductor), and a second choke valve or manifold may be positioned in the first suction system (or between the second gas conduit and the first eductor). The third suction system (or the venturi system) may include a three point connector (such as a "T" shaped connector) to connect the outlets of the first and second suction systems (or the second and third gas conduits to the first eductor), and the first suction system (or the venturi system) may include a choke valve between the first suction system (or the second gas conduit) and the connector, and the second suction system (or the venturi system) may include a choke valve between the second suction system (or the third gas conduit) and the connector. The eductor may have an outlet in gaseous communication with a flare system (as outlined further below).

In a fourth exemplary embodiment, the wellhead apparatus includes a wellhead housing, a first gas conduit, and at least one wellhead housing outlet and at least one upper outlet (or a second and a third gas conduit), and the venturi system includes a first, second and third suction system. Each of the first, second and third suction systems may include one eductor. The outlets of the first and second suction systems may be in gaseous communication with the inlet of the third suction system. Alternatively, the venturi system may include a first eductor, a second eductor and a third eductor (the second eductor may be configured to apply suction to the second gas outlet, and the third eductor may be configured to apply suction to the third gas outlet). The outflows from the eductors of the first and section suction systems (or the second and third eductors) may be connected to a three point connector (such as a "T" or "Y" shaped connector) (which may form part of the third suction system), and the three point connector may also be connected to the eductor of the third suction system (or first eductor, especially so that the first eductor is configured to apply suction to the second and third gas conduits). The venturi system may also include at least one fluid compressor configured to provide fluid to the eductors of the first, second and third suction systems (or the first, second and third eductors) to thereby provide a venturi effect. One or a plurality of choke valves or manifolds may be positioned between the at least one fluid compressor and the eductors of the first, second and third suction systems (or the first, second and third eductors), and a second choke valve or manifold may be positioned intermediate the at least one wellhead housing outlet and the eductor in the first suction system (or between the second gas conduit and the second eductor). A third choke valve or manifold may be positioned intermediate the eductor and the outlet of the first suction system (or between the second eductor and the three point connector). The venturi system may also include a choke valve intermediate the eductor and the outlet of the second suction system (or between the third eductor and the connector). The third suction system (or the first eductor) may have an outlet in gaseous communication with a flare system (as outlined further below).

The well system may further include a flare system. The flare system may be for receiving subterranean gas from the venturi system, wherein the flare system is in gaseous communication with the venturi system. As outlined above, the flare system may be in gaseous communication with the outlet of the suction source (especially the venturi system, for example the outlet of the third suction system). The flare system may also be in gaseous communication with the outlet of at least one eductor (especially the outlet of the first eductor or the outlet of the first and second eductors). In one embodiment of the method of the first aspect, the subterranean gas is diverted to a flare system connected to the venturi system.

The flare system may be adapted to slow the flow rate of gas exiting the suction source (especially the venturi system) (or an eductor in the venturi system), especially to slow the flow rate of gas exiting the suction source (or the eductor) to less than 22 feet per second (above this flow rate water may be atomized within the gas flow). In one embodiment, the flare system includes a knock-out drum. The knock-out drum may be for slowing the flow rate of gas exiting the suction source (or the venturi system, or the at least one eductor). The flow-rate of gas exiting the flare system may be greater than the flow-rate of gas exiting the knock-out drum. The knock-out drum may be a pressure vessel. The knock-out drum may include internal baffles and/or a demister (especially a demister pad, such as a demister pad positioned at the exit of the knock-out drum). The flare system may also include a degasser. The flare system may also include a flare. A flare may be necessary to safely dispose of a mixture of flammable subterranean gas and air. The flare system may also include a flare arrestor, especially towards the outlet of the stack. The stack of the flare system may be from 1 to 15 m long, especially from 5 to 15 m long, more especially from 6 to 14 m or from 7 to 13 m or from 8 to 12 m or from 9 to 11 mm long; most especially about 10 m long. The stack may extend from the knock-out drum, and the knock-out drum may be connected to the outlet of the suction source (or the outlet from the first (or first and third) eductors). The line or pipe in the venturi system connecting the flare system and the at least one upper outlet (or connecting the flare system to the third gas conduit) may be substantially straight or substantially parallel to the ground. The flare system may be transportable. The flare system may be mounted on a skid or trailer. The flare system may be collapsible for movement. The flare system may include a drive for raising and lowering the flare stack. The flare system may also include one or more of stabilizing legs, a control panel, and an igniter gas for the flare.

In another embodiment, the wellhead housing may include a further outlet. Said outlet may be connectable (especially connected to) a pump (especially a mud pump) and at least one associated storage tank.

The method of the present invention may include the step of controlling the proportion of subterranean gas exiting the well bore via the at least one wellhead housing outlet (or the second gas conduit). The method of the present invention may include the step of controlling the proportion of subterranean gas exiting the well bore via the at least one wellhead housing outlet and the at least one upper outlet (or the second and third gas conduits). In one embodiment, substantially all (especially all) subterranean gas exiting the well bore flows through the at least one wellhead housing outlet (or the second gas conduit). In another embodiment, substantially all (especially all) subterranean gas exiting the well bore flows through the at least one wellhead housing outlet and the at least one upper outlet (or the second or third gas conduits). The method of the present invention may include generating a sub-atmospheric pressure within the wellhead apparatus, to thereby ameliorate the vent of subterranean gases to the atmosphere.

The method of the present invention may include the step of applying suction to the at least one wellhead housing outlet and the at least one upper outlet (or the second and third gas conduits), especially to thereby provide a controllable pressure differential within the wellhead apparatus. The method may also include the step of controlling the volumetric flow rate of gas flowing through the at least one wellhead housing outlet and the at least one upper outlet (or the second and/or third gas conduits).

In one embodiment, the method may further include the step of performing a well operation, especially on a component of the wellhead apparatus. Said component may include at least one of the group consisting of: the hanger, the blowout preventer (BOP), a wellhead bonnet, a Christmas tree, a pump drive and the at least one spool. In one embodiment, said component is a blowout preventer. In another embodiment, said component is a hanger. The method may include a method of landing a hanger within the wellhead housing (for example on a hanger mount), or of removing a hanger from the wellhead housing. The well operation may include a well completion, a well servicing, a well intervention or a flush-by operation.

In a third aspect, the present invention provides a method of performing a well operation on a component of a wellhead apparatus, wherein the wellhead apparatus includes a wellhead housing in gaseous communication with subterranean gas exiting a well bore, wherein the wellhead housing includes a first gas conduit and at least one wellhead housing outlet, wherein the first gas conduit has a first end in gaseous communication with the subterranean gas exiting the well bore and a second end distal the first end which is open to the atmosphere, and wherein the at least one wellhead housing outlet is in gaseous communication with the first gas conduit intermediate said first and second ends, the method including the steps of:

a. applying suction to the at least one wellhead housing outlet to divert the flow of gas within the first gas conduit such that substantially no subterranean gas exits to the atmosphere via the first gas conduit second end (or applying suction to the at least one wellhead housing outlet to divert the flow of gas within the first gas conduit such that substantially all subterranean gas flows through the at least one wellhead housing outlet); and b. performing an operation on the component of the wellhead apparatus.

In a fourth aspect, the present invention provides a method of performing a well operation on a component of a wellhead apparatus in gaseous communication with subterranean gas exiting a well bore, wherein the wellhead apparatus includes a wellhead housing and at least one spool, wherein the wellhead housing and the at least one spool define a first gas conduit having a top end open to the atmosphere and a bottom end in gaseous communication with the subterranean gas exiting the well bore, wherein the wellhead housing includes at least one wellhead housing outlet in gaseous communication with the first gas conduit intermediate the at least one spool and the bottom end, and the at least one spool includes at least one upper outlet in gaseous communication with the first gas conduit intermediate the top end and the at least one wellhead housing outlet, the method including the steps of:

a. applying suction to the at least one wellhead housing outlet and the at least one upper outlet such that substantially all subterranean gas is diverted away from the first gas conduit top end; and b. performing the operation on the component of the wellhead apparatus.

Features of the third and fourth aspects of the present invention may be as described above for the first and second aspects of the present invention.

In the third and fourth aspects of the invention, the step of performing an operation on the component of the wellhead apparatus may include servicing the component of the wellhead apparatus (including replacing the component of the wellhead apparatus or repairing the component of the wellhead apparatus) or installing a component of a wellhead apparatus (such as a blowout preventer).

The methods may further include the step of monitoring the flow of subterranean gas through the first conduit. This step may involve monitoring at least one sensor for sensing the pressure within the first gas conduit. As described above, the sensor may be located within or adjacent to the first gas conduit (and may be located distal to the well bore (or wellhead housing)). This step may also involve monitoring at least one sensor in the venturi system, especially said first sensor located in the first suction system (for example at a first choke manifold). Advantageously, the first sensor may be used to determine when the well is placed under reduced pressure.

In a fifth aspect, the present invention provides a method of opening a wellhead housing to the atmosphere, wherein the wellhead housing is part of a wellhead system including:

(i) the wellhead housing, wherein the wellhead housing is in gaseous communication with subterranean gas exiting a well bore and includes a first gas conduit and at least one wellhead housing outlet, wherein the first gas conduit has a first end in gaseous communication with the subterranean gas exiting the well bore and a second end distal the first end closed to the atmosphere, and the at least one wellhead housing outlet is in gaseous communication with the first gas conduit intermediate said first and second ends;

(ii) a suction source configured to apply suction to the at least one wellhead housing outlet, and a pressure sensor for sensing the pressure at the at least one wellhead housing outlet;

the method including the steps of:

a. applying suction to the at least one wellhead housing outlet;

b. sensing the pressure at least one wellhead housing outlet with the pressure sensor; and c. once the pressure sensed in step b. is negative, opening the first gas conduit to the atmosphere at a point distal to the well bore and first gas conduit.

In one embodiment of the fifth aspect, the present invention provides a method of opening a wellhead housing to the atmosphere, wherein the wellhead housing is part of a wellhead system including:

(i) the wellhead housing, wherein the wellhead housing is in gaseous communication with subterranean gas exiting a well bore and includes a first gas conduit and at least one wellhead housing outlet, wherein the first gas conduit has a first end in gaseous communication with the subterranean gas exiting the well bore and a second end distal the first end closed to the atmosphere, and the at least one wellhead housing outlet is in gaseous communication with the first gas conduit intermediate said first and second ends;

(ii) a venturi system including at least one eductor configured to apply suction to the at least one wellhead housing outlet, at least one fluid compressor configured to provide fluid to the at least one eductor to thereby provide a venturi effect, and a pressure sensor for sensing the pressure in a conduit between the at least one eductor and the at least one wellhead housing outlet;

the method including the steps of:

a. providing fluid to the at least one eductor to thereby apply suction to the at least one wellhead housing outlet;

b. sensing the pressure in the conduit between the at least one eductor and the at least one wellhead housing outlet with the pressure sensor; and c. once the pressure sensed in step b. is negative, opening the first gas conduit to the atmosphere at a point distal to the well bore and first gas conduit.

In the fifth aspect, the wellhead system may also include: (iii) a flare system in gaseous communication with the outlet of the at least one eductor. It may be advantageous to include a flare system to safely dispose of the subterranean gas.

In the fifth aspect, the venturi system may include one or more of a first suction system, a second suction system or a third suction system, as defined above.

The fifth aspect may further include one or more of the following:

the conduit between the at least one eductor and the at least one wellhead housing outlet is closed, and the conduit between the at least one eductor and the fluid compressor is closed;

step a. may include: (i) opening the conduit between the at least one eductor and the at least one wellhead housing outlet; and (ii) opening the conduit between the at least one eductor and the fluid compressor to apply suction to the at least one wellhead housing outlet;

a conduit between the at least one eductor and at least one wellhead housing outlet includes a first valve for opening and closing the conduit (said eductor and said first valve may form part of the first suction system);

the first valve may be a first choke valve; more especially a high pressure choke valve or manifold;

a high pressure line may be provided between the at least one wellhead housing outlet and the first valve;

the pressure sensor may be for sensing the pressure at or adjacent the first valve;

a third valve may be provided (especially a third choke valve or manifold) intermediate the first valve and the at least one eductor, and before step a. the step of opening the third valve may be included;

the conduit between the at least one eductor and the fluid compressor includes a second valve for opening and closing the conduit;

the second valve may be a second choke valve and/or a shut off valve;

the conduit between the at least one eductor and the fluid compressor includes a back pressure valve for preventing wellbore fluid flowing to the fluid compressor;

the wellhead apparatus includes a pressure sensor for sensing the pressure within or adjacent to the first gas conduit, and before step a. sensing the pressure within the first gas conduit. Optionally, the method may include before step a: bleeding off the pressure in the first gas conduit (this may be advantageous if the pressure within the first gas conduit exceeds the working pressure of the line between the first and third valves or of the line between the first valve and the at least one eductor). To bleed off the pressure in the first gas conduit, the first valve may be a first choke valve or first choke manifold;

The wellhead housing may form part of a wellhead apparatus, and the wellhead apparatus may include a wellhead bonnet for closing the first gas conduit to the atmosphere. Step c. may include removing the wellhead bonnet. Step c. may also include removing one or more of a Christmas tree and a pump drive from the wellhead apparatus; and After step a.: activating the fluid compressor.

Features of the fifth aspect may include features of the first to fourth aspects discussed above.

In a sixth aspect, the present invention provides a method of removing a hanger in a wellhead system, wherein the wellhead system includes:

(i) A wellhead apparatus including: a wellhead housing and a hanger, wherein the wellhead housing is in gaseous communication with subterranean gas exiting a well bore, and wherein the wellhead housing includes a first gas conduit and at least one wellhead housing outlet, wherein the first gas conduit has a first end in gaseous communication with the subterranean gas exiting the well bore and a second end distal the first end closed to the atmosphere, and the at least one wellhead housing outlet is in gaseous communication with the first gas conduit intermediate said first and second ends, and wherein the hanger is positioned within the first gas conduit; and (ii) A suction source configured to apply suction to the at least one wellhead housing outlet, and a pressure sensor for sensing the pressure at the at least one wellhead housing outlet, wherein the method includes the steps of:

a. applying suction to the at least one wellhead housing outlet;

b. sensing the pressure at the at least one wellhead housing outlet with the pressure sensor;

c. once the pressure sensed in step b. is negative, opening the first gas conduit to the atmosphere at a point distal to the well bore;

d. mounting at least one spool relative to the wellhead housing, wherein the at least one spool provides at least one upper outlet in gaseous communication with the first gas conduit;

e. connecting the at least one upper outlet to the suction source, and applying suction to the at least one upper outlet; and f. removing the hanger from the wellhead apparatus.

In one embodiment of the sixth aspect, the present invention provides a method of removing a hanger in a wellhead system, wherein the wellhead system includes:

(i) A wellhead apparatus including: a wellhead housing and a hanger, wherein the wellhead housing is in gaseous communication with subterranean gas exiting a well bore, and wherein the wellhead housing includes a first gas conduit and at least one wellhead housing outlet, wherein the first gas conduit has a first end in gaseous communication with the subterranean gas exiting the well bore and a second end distal the first end closed to the atmosphere, and the at least one wellhead housing outlet is in gaseous communication with the first gas conduit intermediate said first and second ends, and wherein the hanger is positioned within the first gas conduit; and (ii) A venturi system including at least one eductor configured to apply suction to the at least one wellhead housing outlet, at least one fluid compressor configured to provide fluid to the at least one eductor to thereby provide a venturi effect, and a pressure sensor for sensing the pressure in a conduit between the at least one eductor and the at least one wellhead housing outlet, wherein the method includes the steps of:

a. providing fluid to the at least one eductor to thereby apply suction to the at least one wellhead housing outlet;

b. sensing the pressure in the conduit between the at least one eductor and the at least one wellhead housing outlet with the pressure sensor;

c. once the pressure sensed in step b. is negative, opening the first gas conduit to the atmosphere at a point distal to the well bore;

d. mounting at least one spool relative to the wellhead housing, wherein the at least one spool provides at least one upper outlet in gaseous communication with the first gas conduit;

e. connecting the at least one upper outlet to the at least one eductor, and applying suction to the at least one upper outlet; and f. removing the hanger from the wellhead apparatus.

In the sixth aspect, the wellhead system may also include: (iii) a flare system in gaseous communication with the outlet of the at least one eductor. It may be advantageous to include a flare system to safely dispose of the subterranean gas.

In the sixth aspect, the venturi system may include one or more of a first suction system, a second suction system or a third suction system, as defined above.

The sixth aspect may further include one or more of the following:

in the venturi system, the conduit between the at least one eductor and the at least one wellhead housing outlet is closed, and wherein the conduit between the at least one eductor and the at least one fluid compressor is closed;

step a. may include the step of: (i) opening the conduit between the at least one eductor and the at least one wellhead housing outlet; and (ii) opening the conduit between the at least one eductor and the at least one fluid compressor to apply suction to the at least one wellhead housing outlet;

the conduit between the at least one eductor and the at least one wellhead housing outlet includes at least a first valve for opening and closing the conduit (said at least one eductor and at least a first valve may form part of the first suction system);

the first valve may be a first choke valve; more especially a high pressure choke valve or manifold;

a high pressure line may be provided between the at least one wellhead housing outlet and the first valve;

the pressure sensor may be for sensing the pressure at or adjacent the first valve;

a third valve may be provided (especially a third choke valve or manifold) intermediate the first valve and the at least one eductor, and before step a. the step of opening the third valve may be included;

the conduit between the at least one eductor and the at least one fluid compressor includes a second valve for opening and closing the conduit;

the second valve may be a second choke valve and/or a shut off valve;

the conduit between the at least one eductor and the at least one fluid compressor includes a back pressure valve for preventing wellbore fluid flowing to the at least one fluid compressor;

providing a pressure sensor for sensing the pressure within or adjacent to the first gas conduit, and before step a. sensing the pressure within the first gas conduit. Optionally, the method may include before step a: bleeding off the pressure in the first gas conduit (this may be advantageous if the pressure within the first gas conduit exceeds the working pressure of the line between the first and third valves or of the line or pipe between the first valve and the at least one eductor). To bleed off the pressure in the first gas conduit, the first valve may be a first choke valve or first choke manifold;

The wellhead apparatus may also include Christmas tree valves in gaseous communication with the first gas conduit. The wellhead apparatus may also include a pressure sensor in the first gas conduit proximate the Christmas tree valves. During the method the pressure sensor may be monitored to ascertain if the wellhead apparatus (especially the hanger, and associated flow control valves or penetrations) are leaking;

The wellhead apparatus may include one or more of: a wellhead bonnet for closing the first gas conduit to the atmosphere, a pump drive, and a Christmas tree. Step c. may include removing one or more of (especially all of): the wellhead bonnet, the pump drive and the Christmas tree;

After step a.: activating the at least one fluid compressor;

In step d. the at least one spool may be an eductor spool;

Step d. may include mounting a blowout preventer relative to the wellhead housing, and then mounting at least one spool (especially an eductor spool) relative to the blowout preventer; especially connecting a blowout preventer to the wellhead housing, and connecting at least one spool to the blowout preventer;

Step e. connecting the at least one upper outlet (or third gas conduit) to the venturi system (for example by way of a second suction system), and applying suction to the at least one upper outlet may include:

The venturi system may include a three point connector in which a first point connects to a conduit to the at least one wellhead housing outlet (or in which the connector forms part of the third suction system, and the first point connects to the first suction system), a second point connects to a conduit to a closed valve (especially a choke valve) (said closed valve may form an inlet to the third suction system), and a third point connects to a conduit to a first eductor (which may form part of the third suction system); and in step e. the at least one upper outlet may be connected to the closed valve (for example by way of a second suction system), which is opened to apply suction to the at least one upper outlet; or The venturi system may include a three point connector in which a first point connects to a conduit to the at least one fluid compressor, a second point connects to a conduit to a first eductor (said first eductor may form part of a first suction system), and a third point connects to a conduit to a second eductor (said second eductor may form part of a second suction system), wherein the conduit between the three point connector and the second eductor is closed; and in step e. the at least one upper outlet may be connected to the second eductor, and the conduit between the three point connector and the second eductor is opened;

The conduit between the three point connector and the first eductor may include a valve, especially a choke valve, more especially a choke manifold (said valve may form part of the first suction system). The conduit between the three point connector and the second eductor may include a valve, especially a choke valve, more especially a choke manifold (said valve may form part of the second suction system).

Steps e. and f may include:

If the hanger does not include a completion (including a tubing string extending into the wellbore, and optionally a pump (such as a multistage or progressive cavity pump)), the steps may include one or more of the following:

Removing any back pressure valve or two way check valve;

Installing a hanger landing joint with a valve (especially an in-line valve);

Open the hanger landing joint valve, creating a gaseous flow path between the at least one wellhead housing outlet and the at least one upper outlet (or the second a third gas conduits) via the hanger landing joint;

Applying maximum suction to the at least one upper outlet (or the third gas conduit);

Mechanically pulling the hanger away from the wellhead housing, optionally together with decreasing the suction applied to the at least one wellhead housing outlet (or the second gas conduit); and Once the hanger is separated from the wellhead housing, closing the hanger landing joint valve;

If the hanger includes a completion (including a tubing string extending into the wellbore, and optionally a pump (such as a multistage or progressive cavity pump)), the steps may include one or more of the following:

Closing the tubing string extending into the wellbore;

Installing a hanger landing joint;

Applying maximum suction to the at least one upper outlet (or the third gas conduit); and Mechanically pulling the hanger away from the wellhead housing, optionally together with decreasing the suction applied to the at least one wellhead housing outlet (or the second gas conduit).

Steps f may include: removing fasteners (such as bolts) fastening the hanger to the wellhead housing, and/or connecting a lifting nubbin for lifting the hanger.

Features of the sixth aspect may include features of the first to fourth aspects discussed above.

In a seventh aspect, the present invention relates to a method of landing a hanger assembly in a wellhead system, wherein the wellhead system includes:

(i) A wellhead apparatus including a wellhead housing and at least one spool, wherein the wellhead housing is in gaseous communication with subterranean gas exiting a well bore, wherein the wellhead housing and the at least one spool define a first gas conduit having a top end open to the atmosphere, a bottom end in gaseous communication with the subterranean gas exiting the well bore, and a hanger landing position intermediate the top and bottom ends, wherein the wellhead housing provides at least one wellhead housing outlet in gaseous communication with the first gas conduit intermediate the hanger landing position and the bottom end, and the at least one spool provides at least one upper outlet in gaseous communication with the first gas conduit intermediate the top end and the hanger landing position;

(ii) A suction source applying suction to the at least one wellhead housing outlet and to the at least one upper outlet;

wherein the method includes the steps of:

a. lowering a hanger assembly into the first gas conduit to its landing position, wherein the hanger assembly includes a hanger and a hanger landing tool;

b. decreasing the suction applied at the at least one upper outlet to thereby pull the hanger assembly into position via the at least one wellhead housing outlet until substantially no suction is applied through the at least one upper outlet; and c. holding the hanger assembly in place.

In the seventh aspect, the suction source may be a venturi system including at least one eductor configured to apply suction to the at least one wellhead housing outlet and to the at least one upper outlet, at least one fluid compressor configured to provide fluid to the at least one eductor to thereby provide a venturi effect, wherein suction is applied to the at least one wellhead housing outlet and to the at least one upper outlet.

In the seventh aspect, the wellhead system may also include: (iii) a flare system in gaseous communication with the outlet of the at least one eductor. It may be advantageous to include a flare system to safely dispose of the subterranean gas.

In the seventh aspect, the venturi system may include one or more of a first suction system, a second suction system or a third suction system, as defined above.

The seventh aspect may further include one or more of the following:

The venturi system may include a pressure sensor for sensing the pressure in the conduit between the at least one eductor and the at least one wellhead housing outlet (or the second gas conduit);

The conduit between the at least one eductor and the at least one wellhead housing outlet (or the second gas conduit) includes a first valve for opening and closing the conduit (said choke valve and/or the at least one eductor may form part of the first suction system);

the first valve may be a first choke valve; more especially a high pressure choke valve or manifold;

a high pressure line may be provided between the at least one wellhead housing outlet (or the second gas conduit) and the first valve;

the pressure sensor is for sensing the pressure at or adjacent the first valve;

a third valve may be provided (especially a third choke valve or manifold) intermediate the first valve and the at least one eductor;

The conduit between the at least one eductor and the fluid compressor includes a second valve for opening and closing the conduit;

the second valve may be a second choke valve and/or a shut off valve;

The conduit between the at least one eductor and the fluid compressor includes a back pressure valve for preventing wellbore fluid flowing to the fluid compressor;

The venturi system may include a three point connector in which a first point connects to a conduit to the at least one wellhead housing outlet (or the second gas conduit), a second point connects to a conduit to the at least one upper outlet (or the third gas conduit), and a third point connects to a conduit to the at least one eductor (in this system the third suction system may include the at least one eductor and the three point connector, and the connector first point may connect to the outlet of the first suction system and the connector second point may connect to the outlet of the second suction system);

the conduit between the three point connector and the at least one upper outlet (or third gas conduit) may be closable, especially by a valve, more especially by a choke valve;

The venturi system may include a three point connector in which a first point connects to a conduit to the at least one fluid compressor, a second point connects to a conduit to a first eductor (said first eductor may form part of a first suction system), and a third point connects to a conduit to a second eductor (said second eductor may form part of a second suction system), wherein the first eductor is configured to apply suction to the at least one wellhead housing outlet (or second gas conduit), and the second eductor is configured to apply suction to the at least one upper outlet (or third gas conduit);

The conduit between the three point connector and the at least one fluid compressor may include a back-pressure valve for preventing wellbore fluid flowing to the at least one fluid compressor;

The conduit between the three point connector and the first eductor may be closeable, especially by a valve, more especially by a choke valve (the valve may form part of the first suction system);

The conduit between the three point connector and the second eductor may be closeable, especially by a valve, more especially by a choke valve (said valve may form part of the second suction system);

Step a. may include:

If the hanger assembly does not include a completion (including a tubing string for extending into the wellbore, and optionally a pump (such as a multi-stage or progressive cavity pump)), the steps may include one or more of the following:

The hanger assembly includes an open valve (especially an in-line valve) to allow gas flow across the hanger; and Once the hanger assembly is in the landing position, the hanger assembly valve may be closed;

If the hanger assembly includes a completion (including a tubing string for extending into the wellbore), the steps may include one or more of the following:

Closing the tubing string extending into the wellbore; and

Applying suction to the at least one wellhead housing outlet and the at least one upper outlet (or the second and third gas conduits) so as to minimize air flow across the hanger seals;

After step c., step d: removing components including the hanger landing tool and the at least one spool;

After step d., step e: closing the first gas conduit to the atmosphere;

After step e., step f: disconnecting the venturi system from the wellhead housing (or from the at least one wellhead housing outlet and/or the at least one upper outlet);

Step c. may include holding the hanger in place by fasteners (such as tie-down bolts), by suction (such as via a lock down ring), or by compression (such as by rams, such as BOP pipe rams);

Step c. may include fastening the hanger to the wellhead housing using fasteners (such as bolts); and/or removing a lifting nubbin from the hanger;

The wellhead apparatus may further include a blowout preventer, and the blowout preventer may be mounted relative to the wellhead housing, and the at least one spool may be mounted relative to the blowout preventer; the blowout preventer especially may be connected to the wellhead housing, and the at least one spool may be connected to the blowout preventer;

step e. may include removing the blowout preventer; and step e. may include installing one or more of: a wellhead bonnet, a pump drive, and a Christmas tree to the wellhead apparatus.

Features of the seventh aspect may include features of the first to fourth aspects discussed above.

Advantageously, the seventh aspect of the present invention allows the hanger to be safely and effectively dropped in place gradually through the influence of the gas flowing in the first gas conduit. In contrast, under well operations to date the hanger is typically dropped into place without any cushioning flow of gas.

Any of the features described herein can be combined in any combination with any one or more of the other features described herein within the scope of the invention.

The reference to any prior art in this specification is not, and should not be taken as an acknowledgement or any form of suggestion that the prior art forms part of the common general knowledge.

BRIEF DESCRIPTION OF DRAWINGS

Examples of the invention will now be described by way of example with reference to the accompanying Figures, in which.

Figure 1:
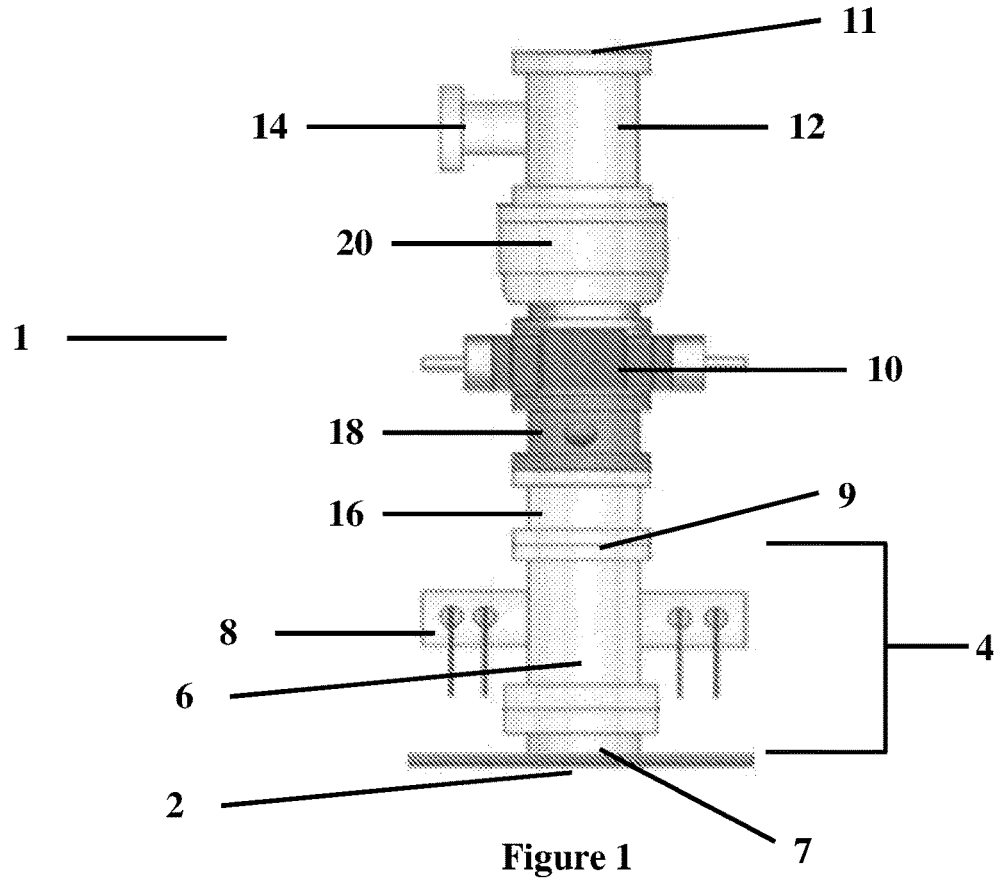
FIG. 1 illustrates a first exemplary wellhead apparatus.

Preferred features, embodiments and variations of the invention may be discerned from the following Description which provides sufficient information for those skilled in the art to perform the invention. The following Description is not to be regarded as limiting the scope of the preceding Summary of the Invention in any way.

DESCRIPTION OF EMBODIMENTS

Embodiments of the invention will now be described with reference to FIGS. 1 to 19. In the figures, like reference numerals refer to like features.

Figure 2:
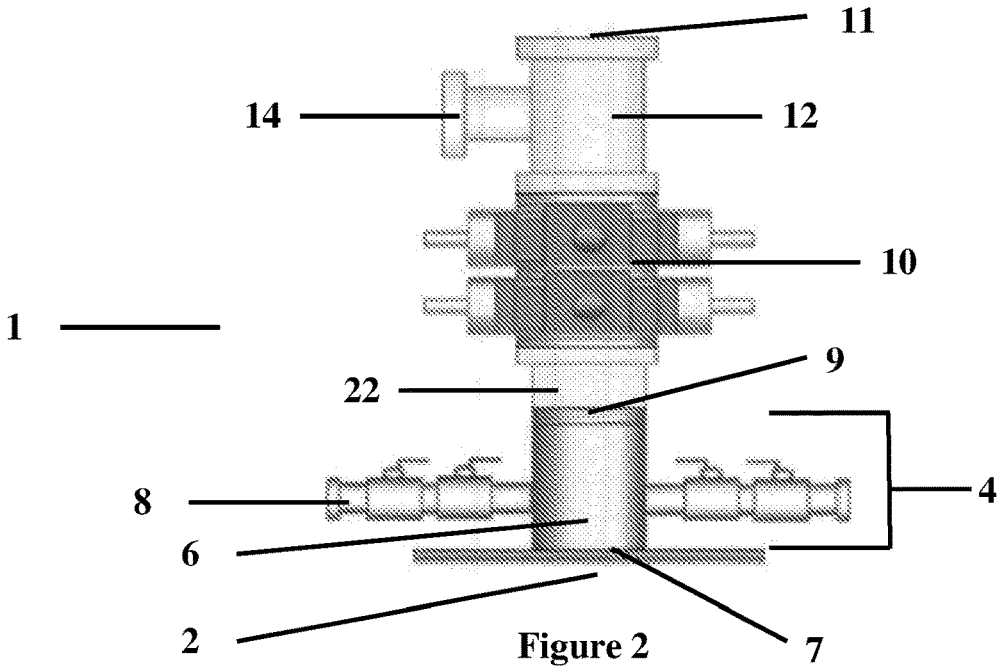
FIG. 2 illustrates a second exemplary wellhead apparatus.

Two wellhead apparatuses 1 are illustrated in FIGS. 1 and 2. The apparatus 1 of FIGS. 1 and 2 includes a wellhead housing 4 in gaseous communication with subterranean gas exiting a well bore 2. The wellhead housing 4 includes a first gas conduit 6 having a first end 7 in gaseous communication with the subterranean gas exiting the well bore 2 and a second end 9 distal the first end, and at least one wellhead housing outlet (or second gas conduit) 8 in gaseous communication with the first gas conduit 6 intermediate the first and second ends 7, 9. The at least one wellhead housing outlet (or second gas conduit) 8 extends perpendicularly to the longitudinal axis of the first gas conduit 6 and is in register with the first gas conduit 6. The wellhead housing 4 is in register with the well bore 2.

As illustrated in FIGS. 1 and 2, the wellhead apparatus 1 also includes a blowout preventer (BOP) 10, and a number of spools including eductor spool 12 (eductor spool 12 is a spool having one transverse outlet). The first gas conduit 6 extends through the well head apparatus 1, passing through the BOP 10 and the eductor spool 12. Each of the wellhead housing 4, BOP 10 and eductor spool 12 are substantially in the form of an annulus, defining a central bore which provides the first gas conduit 6. The first gas conduit 6 is open to the atmosphere, as the eductor spool 12 is not capped. The wellhead apparatus 1 includes a bottom end 7 (which is also the wellhead housing first end), and a top end 11.

At least one upper outlet (or third gas conduit) 14 is provided by the eductor spool 12 outlet, and the at least one upper outlet (or third gas conduit) 14 is in gaseous communication with the first gas conduit 6. The at least one upper outlet (or third gas conduit) 14 extends perpendicularly to the longitudinal axis of the first gas conduit 6 and is in register with the first gas conduit 6. The at least one upper outlet (or third gas conduit) 14 is located on the apparatus 1 distal to the wellbore 2 intermediate the at least one wellhead housing outlet (or second gas conduit) 8 and the wellhead apparatus top end 11.

In FIG. 1, the wellhead housing 4 is a 2 kpsi wellhead housing 4 in two sections (the first section is typically about 180 mm long, and the second section about 533 mm long). Connected to the wellhead housing 2 is a crossover spool 16 (2 kpsi to 3 kpsi. The crossover spool 16 is typically about 230 mm long). Connected to the crossover spool 16 is a drilling spool 18 (3 kpsi. The drilling spool 18 typically includes a test port, and the spool 18 is typically about 305 mm long). Connected to the drilling spool 18 is BOP 10 (a 7¹⁄₁₆" blind ram, the BOP 10 is typically 270 mm long). Connected to the BOP 10 is spool 20 (a 7¹⁄₁₆" torus style annular, typically 534 mm long). Connected to spool 20 is an eductor spool 12 (made from a 9⅝" casing with a 6" low pressure side outlet flange which provides the at least one upper outlet (or third gas conduit) 14).

In FIG. 2, the wellhead housing 4 includes 2" side outlets (which provide the at least one wellhead housing outlet (or second gas conduit) 8). The wellhead housing 4 is typically about 500 mm long. Connected to the wellhead housing 4 is an adaptor spool 22 to connect the wellhead 4 to the BOP 10 (the adaptor spool is typically about 300 mm long). Connected to the adaptor spool 22 is a BOP 10 (a 11" 3000 psi Dual Gate Ram or a 11" 300 psi Single Gate Ram. The BOP 10 may include a test port. The BOP 10 is typically about 1000 mm long). Connected to the BOP 10 is an eductor spool 12 (made from a 9⅝" casing with a 6" low pressure side outlet flange which provides the at least one upper outlet (or third gas conduit) 14).

Figure 3:
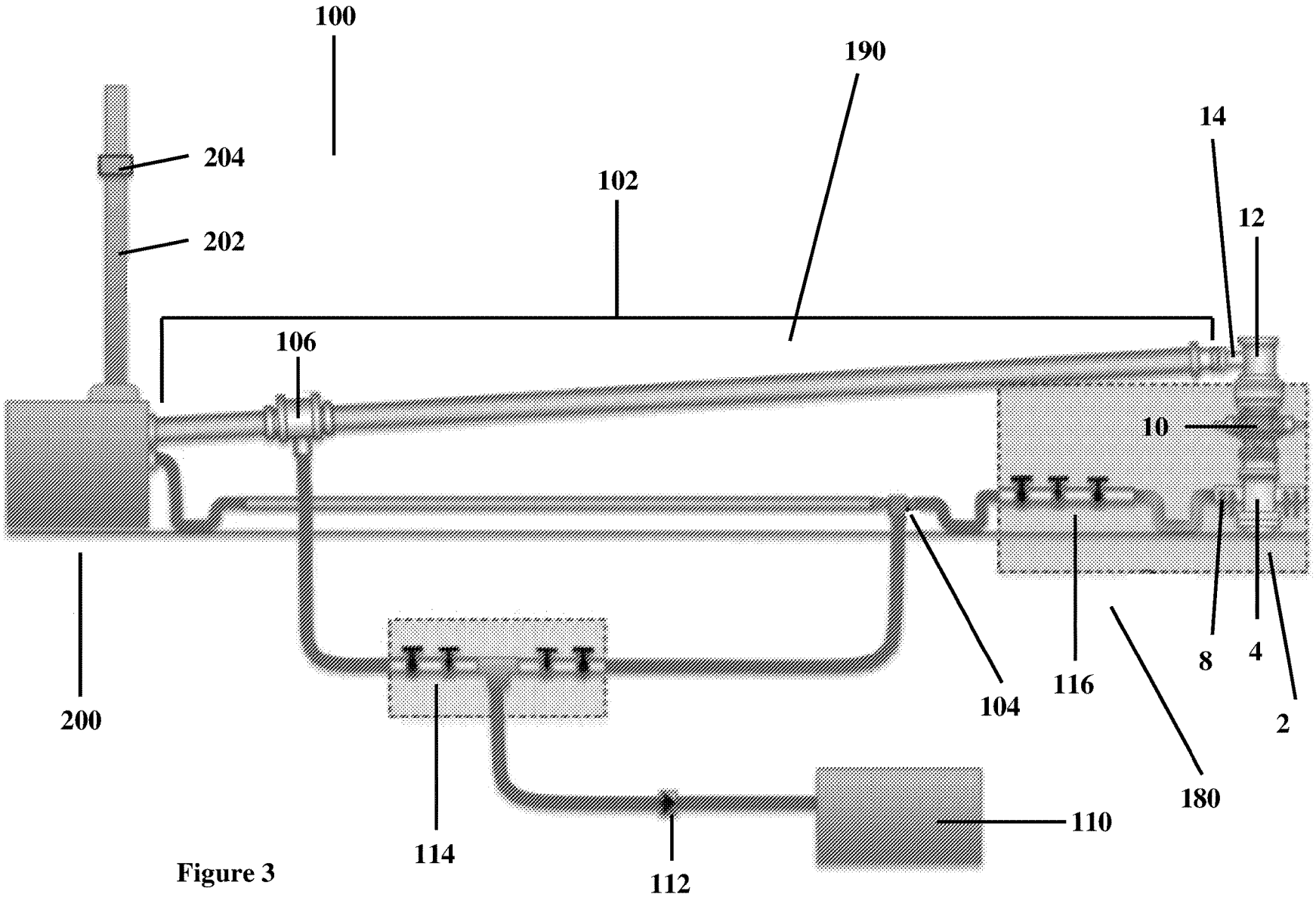
FIG. 3 illustrates a first exemplary well system including the wellhead apparatus illustrated in FIG. 1.
Figure 4:
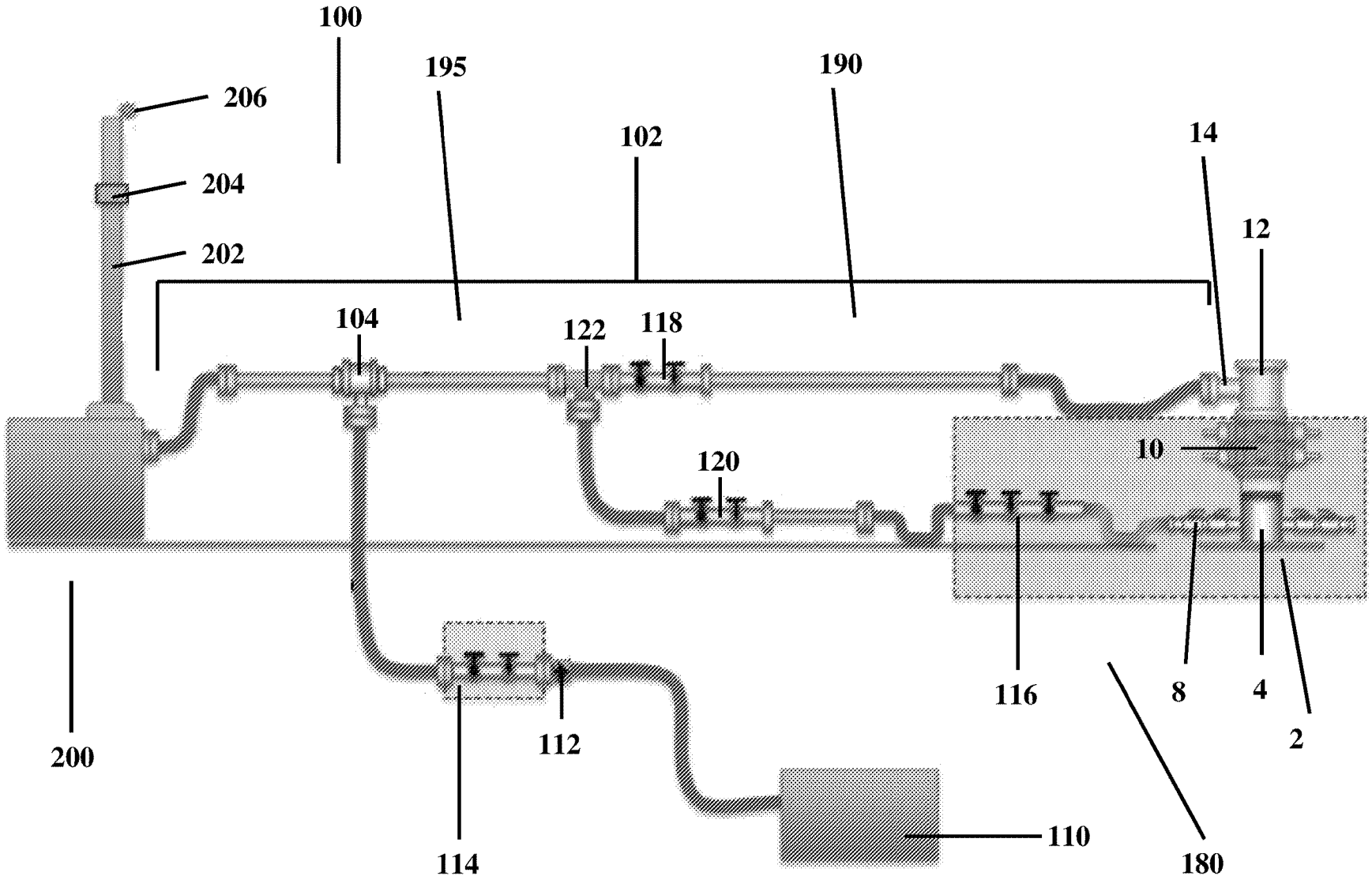
FIG. 4 illustrates a second exemplary well system including the wellhead apparatus illustrated in FIG. 2.

FIGS. 3 and 4 illustrate well systems 100 including the wellhead apparatuses 1 illustrated in FIGS. 1 and 2. The well systems 100 each include a wellhead apparatus 1, a venturi system 102 and a flare system 200.

Referring to FIG. 3, the venturi system 102 includes a first eductor 104 configured to apply suction to the at least one wellhead outlet (or second gas conduit) 8. In FIG. 3, the first eductor 104 is a 2" Schutte & Koerting Style Eductor valve. The venturi system 102 also includes a second eductor 106 configured to apply suction to the at least one upper outlet (or third gas conduit) 14. In FIG. 3, the second eductor 106 is a 10" Mathena Style Eductor valve. The venturi system 102 also includes at least one fluid compressor 110 configured to provide fluid to the first and second eductors 104, 106 to thereby provide a venturi effect. The fluid compressor 110 illustrated in FIG. 3 is a 900 Standard Cubic Feet per Minute Air Compressor. The system 100 illustrated in FIG. 3 also includes valves, including back pressure valve 112, and air choke manifolds 114 and 116. Air choke manifold 116 is adapted for high pressures. An 8" blooie line connects to the at least one upper outlet (or third gas conduit) 14 (at eductor spool 12), and a 2" bleed line connects the first eductor 104 to flare system 200. Flare system 200 includes a flare stack 202 and a flame arrestor 204. In FIG. 3, the venturi system 102 includes a first suction system 180 and a second suction system 190. The first suction system 180 includes an inlet at the at least one wellhead outlet 8 and an outlet at flare system 200. The first suction system 180 includes air choke manifold 116, and first eductor 104. The second suction system 190 includes an inlet at the at least one upper outlet 14 and an outlet at the flare system 200. The second suction system 190 includes second eductor 106.

Referring to FIG. 4, the venturi system 102 includes a first eductor 104 configured to apply suction to the at least one wellhead housing outlet and the at least one upper outlet (or the second and third gas conduits) 8, 14. In FIG. 4, the first eductor 104 is a Mathena Style Valve. The first eductor 104 is able to apply suction to the at least one wellhead housing outlet and the at least one upper outlet (or the second and third gas conduits) 8, 14 through three point connector 122. The venturi system 102 also includes at least one fluid compressor 110 configured to provide fluid to the first eductor 104 to thereby provide a venturi effect. The fluid compressor 110 illustrated in FIG. 4 is a 900 Standard Cubic Feet per Minute Air Compressor. The system 100 illustrated in FIG. 4 also includes valves, including back pressure valve 112, air choke manifolds 114 and 116, and in line chokes 118 and 120. Air choke manifold 116 is adapted for high pressures. The outlet of the first eductor 104 is connected to flare system 200. Flare system 200 includes a flare stack 202, a flame arrestor 204 and a flare 206. The venturi system 102 includes a first suction system 180, a second suction system 190 and a third suction system 195. The first suction system 180 includes an inlet at the at least one wellhead outlet 8 and an outlet at the choke 120. The first suction system 180 includes air choke manifold 116 and choke 120. The second suction system 190 includes an inlet at the at least one upper outlet 14, and an outlet at the choke 118. The second suction system 190 includes choke 118. The third suction system 195 includes an inlet at the chokes 118 and 120, and an outlet at the flare system 200. The third suction system 195 includes connector 122, and first eductor 104.

Figure 15:
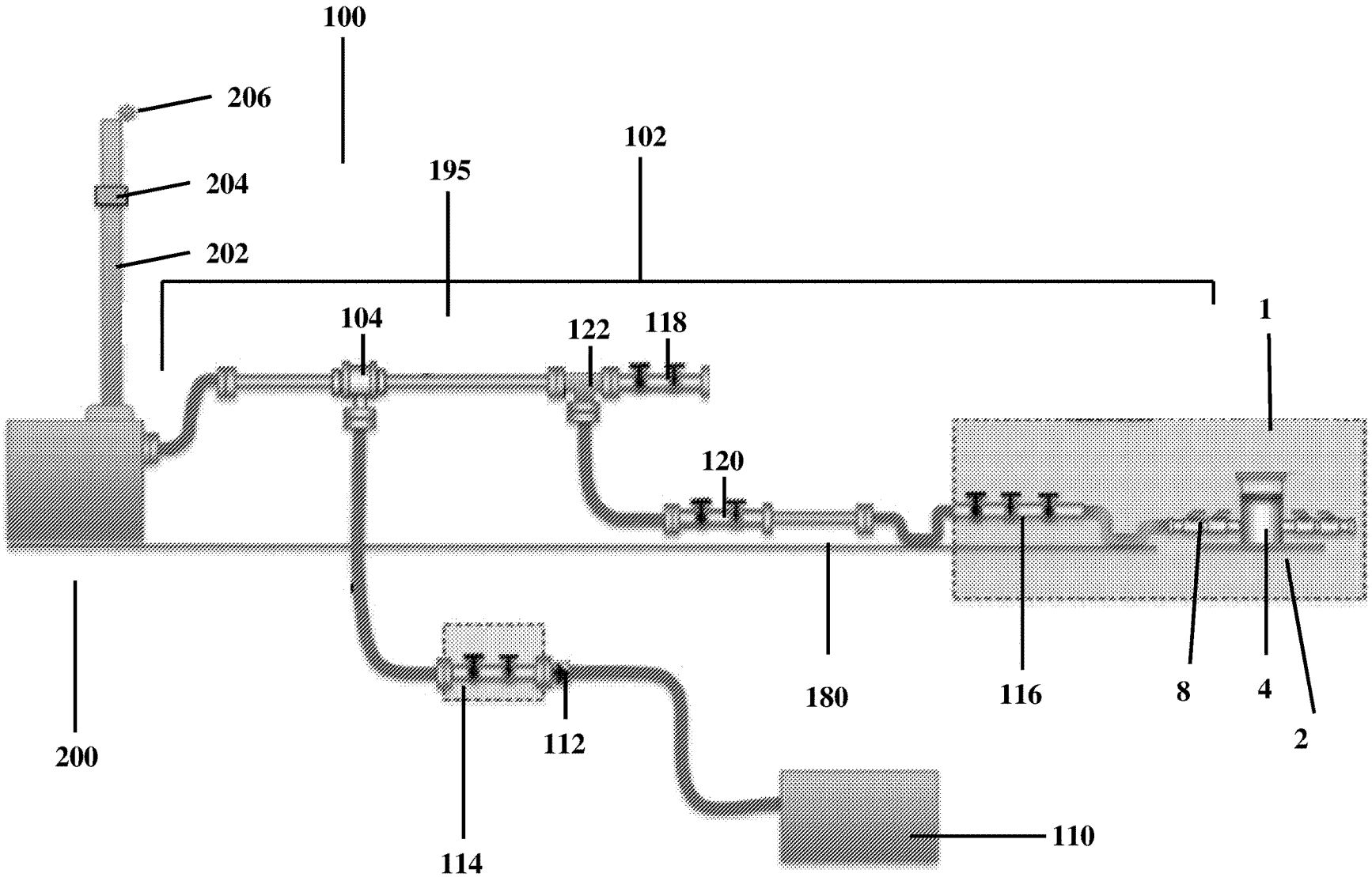
FIG. 15 provides a layout of a ninth exemplary well system.

FIG. 15 illustrates the same well system 100 as shown in FIG. 4, except the well system 100 of FIG. 15 does not include an eductor spool 12, at least one upper outlet (or third gas conduit) 14, conduit extending between third gas conduit 14 and choke 118 (or second suction system 190), and BOP 10.

Figure 14:
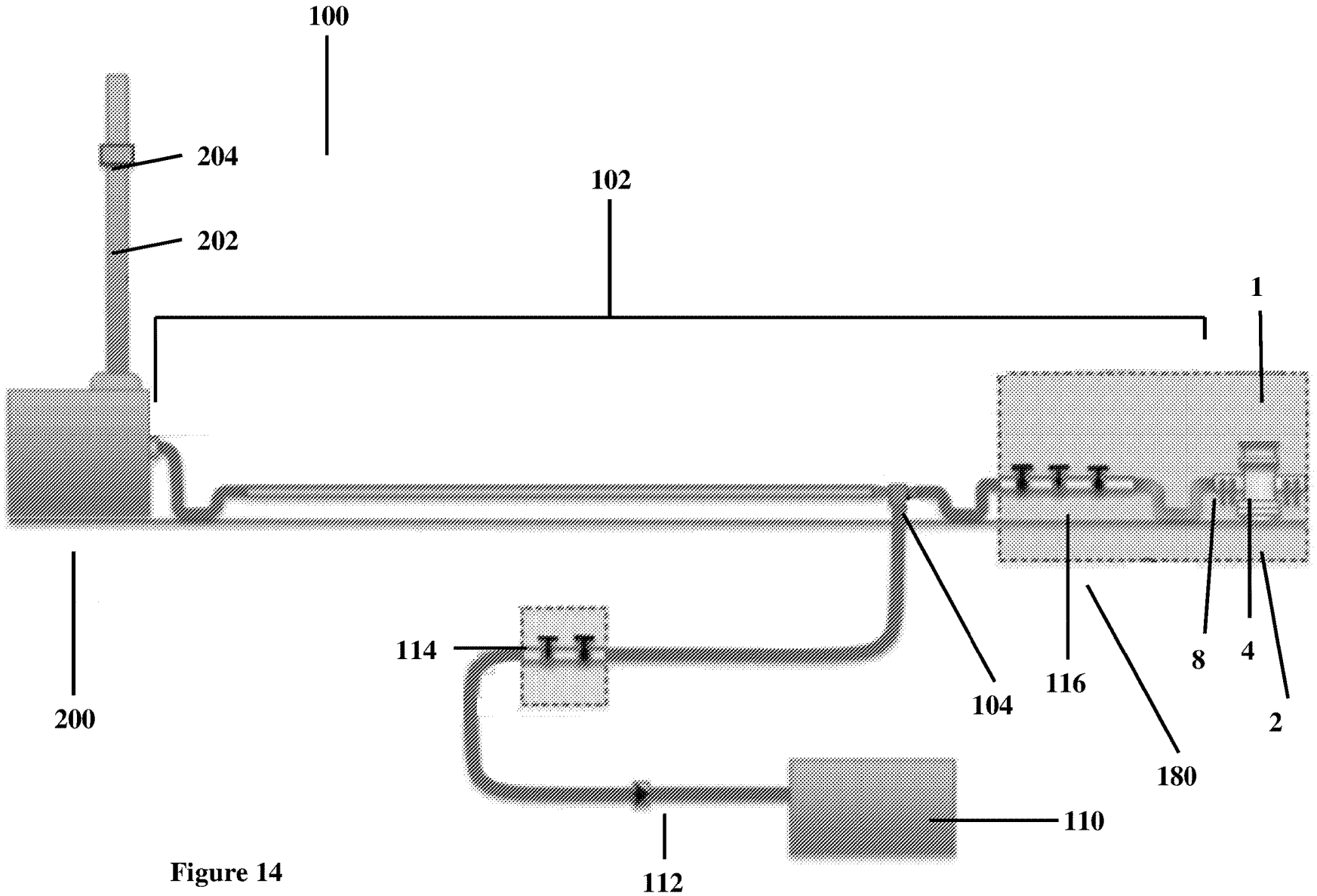
FIG. 14 provides a layout of an eighth exemplary well system.

FIG. 14 illustrates a simpler well system 100 including a wellhead apparatus 1, a venturi system 102 and a flare system 200. The venturi system 102 includes a first eductor 104 configured to apply suction to the at least one wellhead outlet (or second gas conduit) 8. In FIG. 14, the first eductor 104 is a 2" Schutte & Koerting Style Eductor valve. The venturi system 102 also includes at least one fluid compressor 110 configured to provide fluid to the first eductor 104 to thereby provide a venturi effect. The fluid compressor 110 illustrated in FIG. 14 is a 900 Standard Cubic Feet per Minute Air Compressor. The system 100 illustrated in FIG. 14 also includes valves, including back pressure valve 112, and air choke manifolds 114 and 116. Air choke manifold 116 is adapted for high pressures. A 2" bleed line connects the first eductor 104 to flare system 200. Flare system 200 includes a flare stack 202 and a flame arrestor 204. The venturi system 102 includes a first suction system which includes first eductor 104, valve 112 and manifolds 114 and 116.

Figure 19:
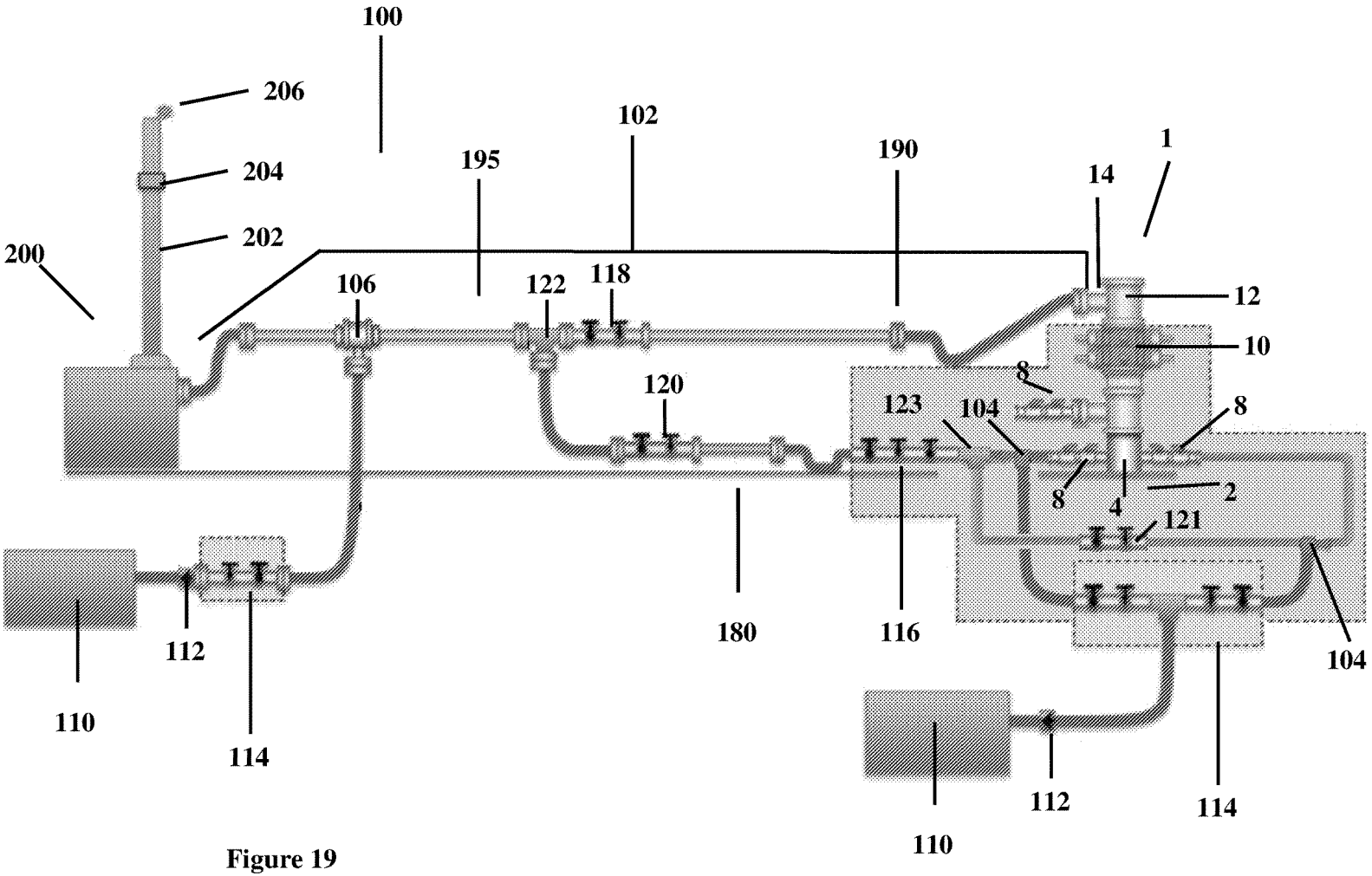
FIG. 19 provides a layout of a tenth exemplary well system.

FIG. 19 illustrates a further well system 100, including a wellhead apparatus 1, a venturi system 102 and a flare system 200. In FIG. 19, the wellhead housing 4 is formed in two parts, with a spool situated directly below the BOP 10. The spool in the wellhead housing 4 includes a further wellhead housing outlet 8 (this outlet 8 is not connected to a pipe or line in the Figure), to provide a total of three wellhead housing outlets 8. It can be advantageous to include a spool in the wellhead 4 as the spool may provide a wider diameter outlet (for example a 4 inch outlet), which correspondingly allows for greater suction to be applied (this may be needed especially if the well produces high volumetric flow rates of gas). Similarly, use of more than one wellhead housing outlet 8 may increase the suction that is able to be applied at the wellhead housing 4.

In FIG. 19 two of the wellhead housing outlets 8 are connected to a high pressure line and then to first eductors 104. First eductors 104 are configured to apply suction to the at least one wellhead housing outlet 8. Fluid is provided to the first eductors 104 from fluid compressor 110 via air choke manifold 114 to thereby provide a venturi effect. The high pressure line also includes an inline choke 121 to control the gas flowing through the line, and a three point connector 123 to combine the gas flowing from the two wellhead housing outlets 8. In line with the connector 123 is air choke manifold 116 and in-line choke 120. The venturi system 102 in FIG. 19 includes a first suction system 180, which includes first eductors 104, inline chokes 121 and 120, three point connector 123, and air choke manifold 116. The outlet of the first suction system is provided by inline choke 120.

The venturi system 102 also includes a second eductor 106 configured to apply suction to the at least one wellhead housing outlet 8 and to an at least one upper outlet 14 (which is provided by an eductor spool 12) through three point connector 122. The line (or pipe) to the at least one upper outlet 14 also includes an inline choke 118. The venturi system 102 includes a second fluid compressor 110 configured to provide fluid to the second eductor 106 via air choke manifold 114 to thereby provide a venturi effect. Both fluid compressors 110 in FIG. 19 also include back pressure valves 112.

The venturi system 102 in FIG. 19 includes a second suction system 190, which includes inline choke 118. The venturi system 102 in FIG. 19 also includes a third suction system 195, which includes second eductor 106, and three point connector 122.

The outlet of the second eductor 106 is connected to flare system 200 (alternatively, the outlet of the third suction system 195 is connected to the flare system 200). Flare system 200 includes a flare stack 202, a flame arrestor 204 and a flare 206.

The layout illustrated in FIG. 19 may also include a further eductor in the second suction system (not shown), which may be connected to a third fluid compressor or to one of the two fluid compressors 110 illustrated. The layout may also further include at least one further eductor (not shown) in series with either the first or second eductors 104, 106 to thereby increase the suction applied to the at least one wellhead housing outlet 8 or to the at least one upper outlet 14. The layout may also further include an additional upper outlet 14 (not shown) to thereby allow greater suction to be applied above the BOP 10. The first suction system 180 may also include at least one further air choke manifold between the first eductors 104 and the at least one wellhead housing outlets 8 (this may be important to assist in regulating the pressure around the wellhead housing 4).

Figure 5:
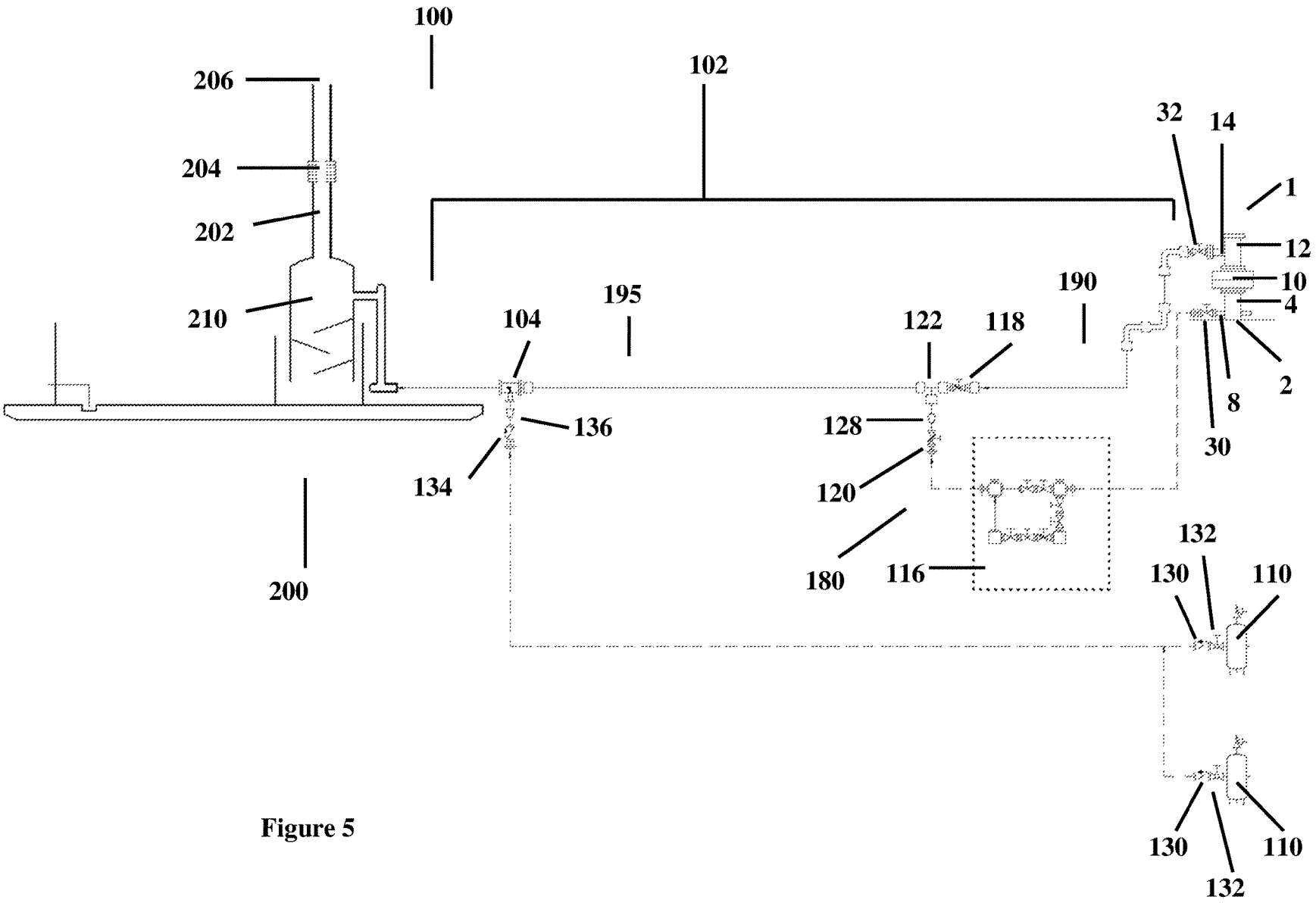
FIG. 5 provides a schematic of a third exemplary well system.

The well system 100 illustrated in FIG. 5 includes wellhead apparatus 1, including eductor spool 12 having an outlet providing the at least one upper outlet (or third gas conduit) 14, a BOP 10, and a wellhead housing 4 including an outlet providing at least one wellhead housing outlet (or second gas conduit) 8. The eductor spool 12, BOP 10 and wellhead housing 4 define a first gas conduit which is open to the atmosphere and which is in gaseous communication with subterranean gas exiting a well bore 2. The at least one wellhead housing outlet (or second gas conduit) 8 includes a 2" isolation valve 30, and the at least one upper outlet (or third gas conduit) 14 includes a 4" isolation valve 32.

The well system 100 illustrated in FIG. 5 also includes a venturi system 102. The venturi system includes a first eductor 104 configured to apply suction to the at least one wellhead outlet (or second gas conduit) 8 and at least one upper outlet (or third gas conduit) 14. The first eductor 104 is able to apply suction to the at least one wellhead outlet (or second gas conduit) 8 and at least one upper outlet (or third gas conduit) 14 through three point connector 122. The three point connector 122 connects to the at least one upper outlet (or third gas conduit) 14 via a 4" line, within which a 4" choke valve 118 is positioned. The three point connector 122 connects to the at least one wellhead housing outlet (or second gas conduit) 8 via a 2" line, within which a 2" choke valve 120, and choke manifold 116 is positioned. Connecting the 2" choke valve 120 to the three point connector 122 is a 4" to 2" pipe reducer 128. A first suction system 180 may be comprised of the choke manifold 116 and choke valve 120. A second suction system 190 may be comprised of the choke valve 118. A third suction system 195 may be comprised of the connector 122 and the first eductor 104.

The venturi system 102 also includes two fluid compressors 110, each of which is a 900 Standard Cubic Feet per Minute Air Compressor. The presence of two fluid compressors 110 in the venturi system 102 provides redundancy should one fluid compressor 110 fail. The fluid compressors 110 are configured to provide fluid to the first eductor 104 to thereby provide a venturi effect. Each fluid compressor 110 includes a check valve 130 and valve 132 connected to a 2" line. The 2" line connects to first eductor 104 via check valve 134 and 4" to 2" pipe reducer 136.

The well system 100 also includes a flare system 200 in gaseous communication with the outlet of the first eductor 104. The flare system 200 includes a knock-out drum 210 (to slow the flow rate of gas exiting the eductor 104), flare stack 202, flare arrestor 204 and flare 206.

Figure 6:
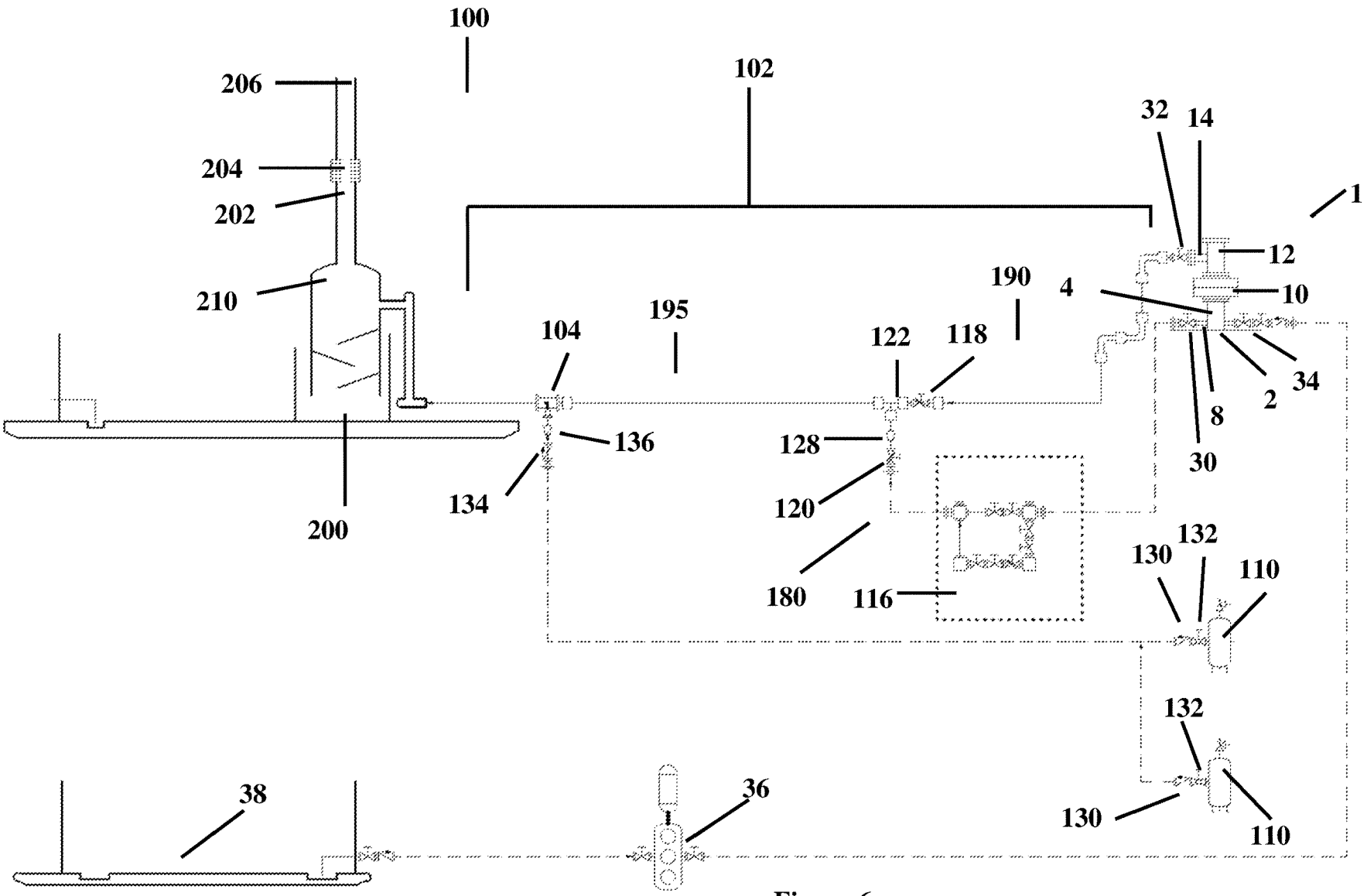
FIG. 6 provides a schematic of a fourth exemplary well system.

The well system 100 illustrated in FIG. 6 is the same as the system 100 illustrated in FIG. 5, except that the wellhead housing 4 includes a further outlet 34 with associated valves (including a check valve). The wellhead housing outlet 34 is connected to a mud pump 36 and then to storage tank 38.

Figure 7:
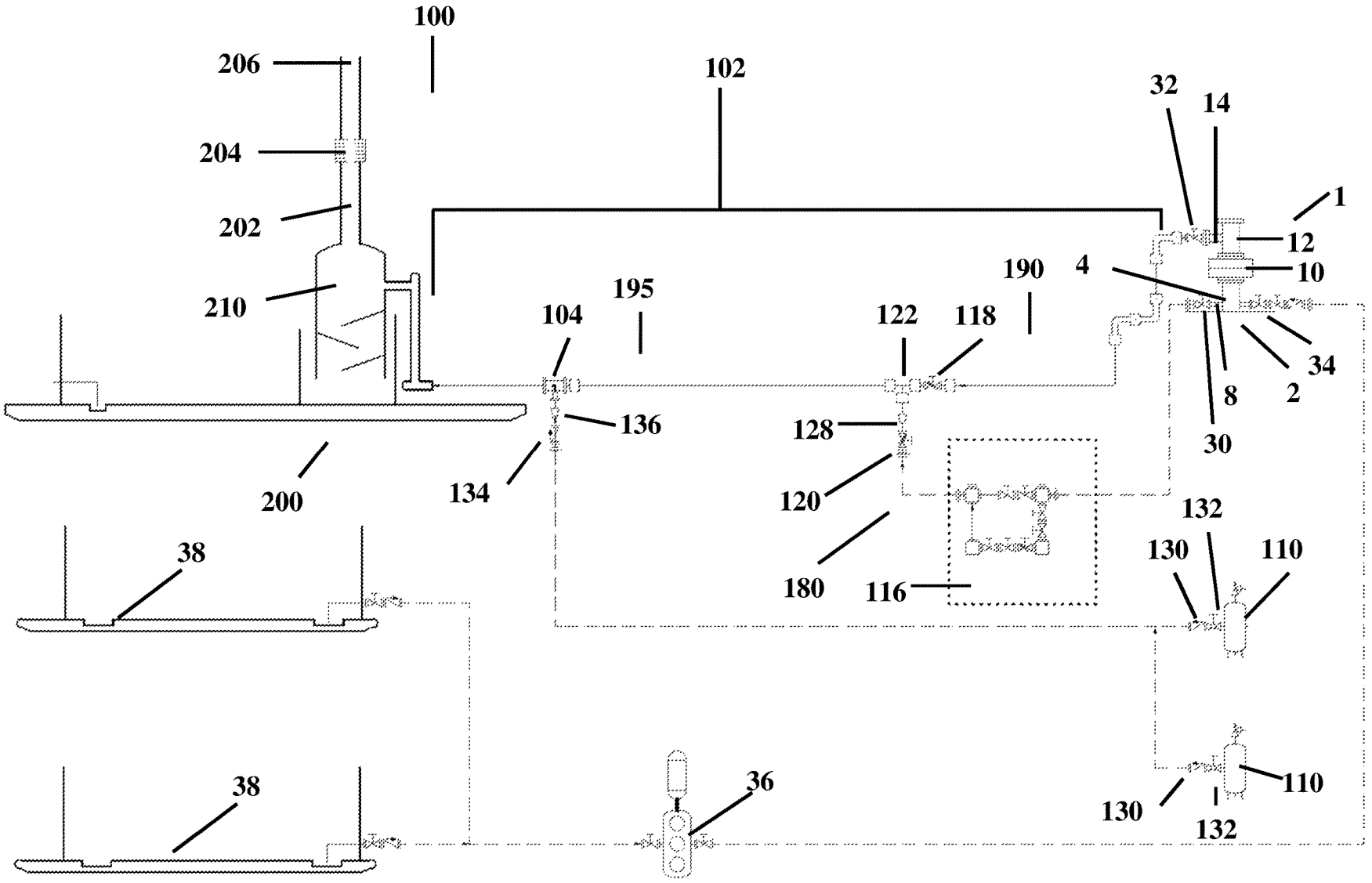
FIG. 7 provides a schematic of a fifth exemplary well system.

The well system 100 illustrated in FIG. 7 is the same as the system 100 illustrated in FIG. 6, except that the mud pump 36 connects to two storage tanks 38.

Figure 8:
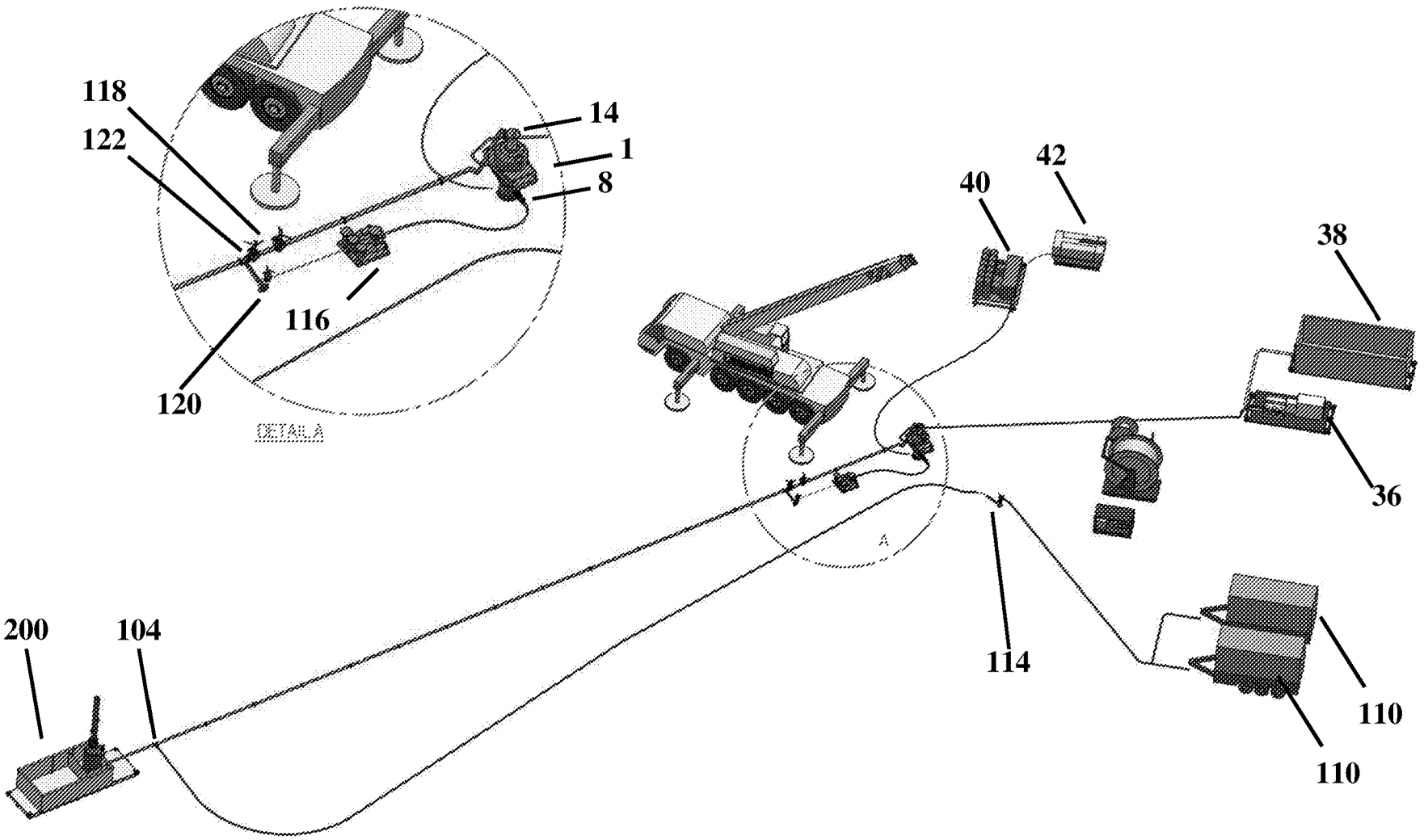
FIG. 8 provides a layout of a sixth exemplary well system.

The well system 100 illustrated in FIG. 8 is similar to the system 100 illustrated in FIG. 6. In this system there is again two fluid compressors 110 connected to first eductor 104 via control valve 114 (which may be a choke manifold). The first eductor 104 is connected to the at least one wellhead outlet (or second gas conduit) 8 and at least one upper outlet (or third gas conduit) 14 via a 4" blooie line which branches at three point connector 122. The line connecting the three point connector 122 to the at least one upper outlet (or third gas conduit) 14 includes a choke and isolator valve 118. A 2" line connects the three point connector 122 to the first gas conduit 8, and within this line is positioned a 2" choke and isolator valve 120 and a choke manifold 116. A further outlet extends from the wellhead housing, and this outlet is connected to a mud pump 36 and then to a storage tank 38. The well system 100 illustrated in FIG. 8 also includes a blowout preventer hydraulic power unit (BOP HPU) 40 connected to the BOP 10 in wellhead apparatus 1 and a generator 42 to power the BOP HPU 40.

Figure 9:
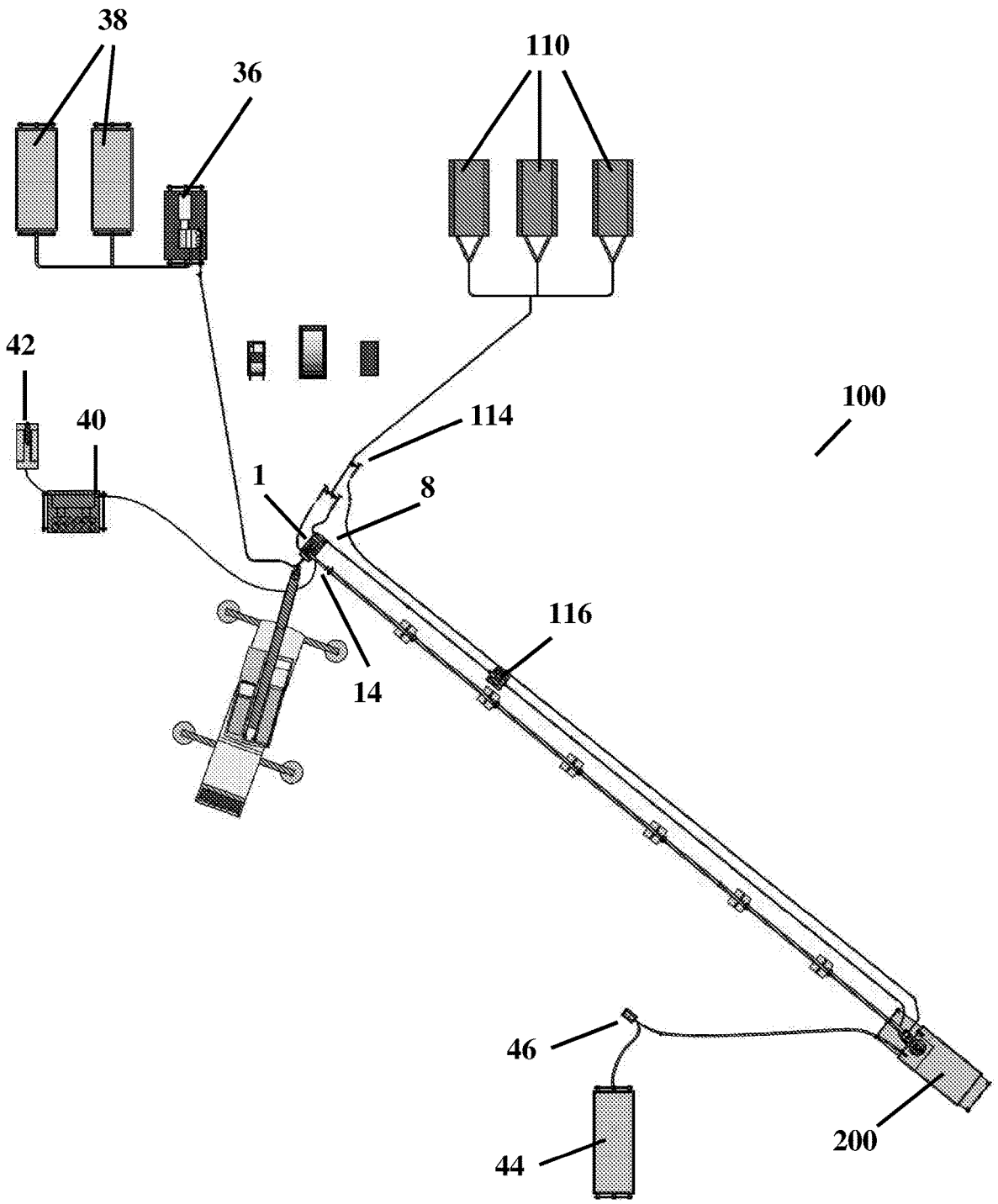
FIG. 9 provides a layout of a seventh exemplary well system.
Figure 10:
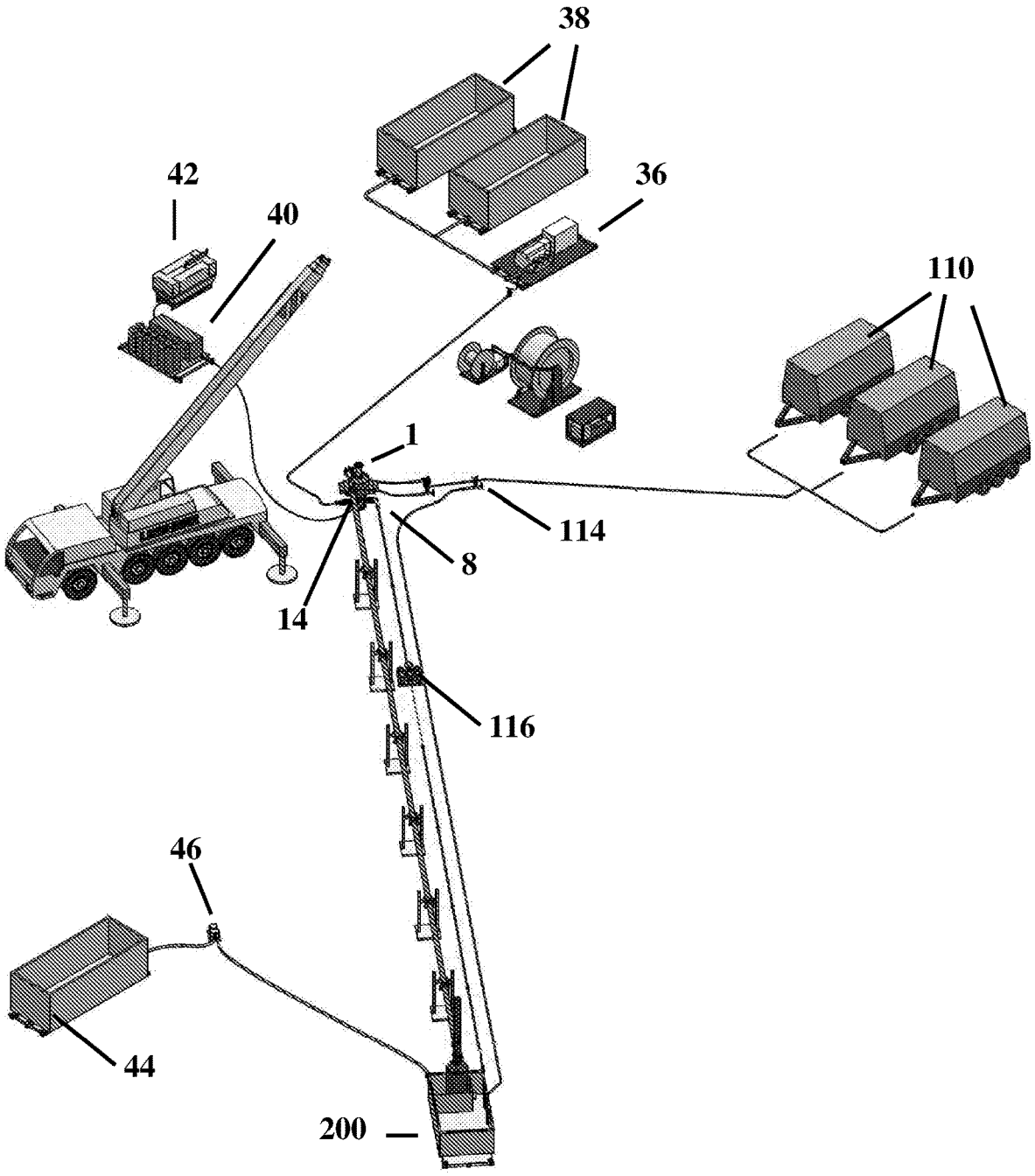
FIG. 10 provides a layout of the well system shown in FIG. 9.
Figure 11:
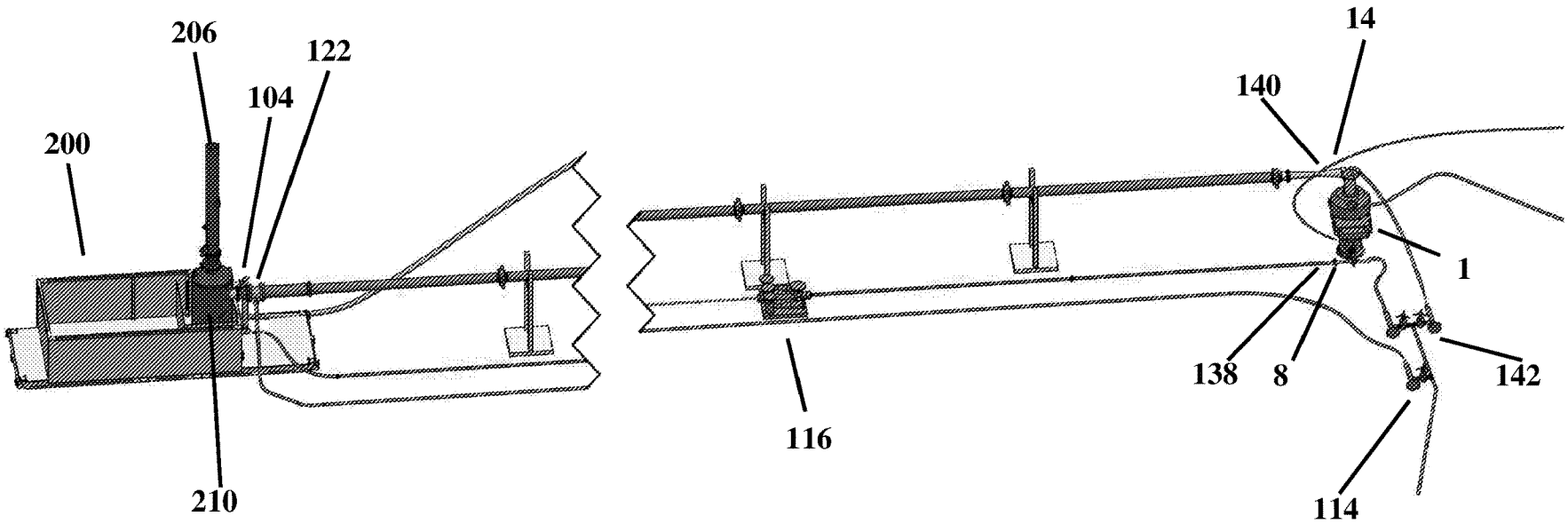
FIG. 11 provides a perspective view of the venturi system between the well head apparatus and the flare system of the well system shown in FIG. 9.

The well system 100 illustrated in FIGS. 9-11 is similar to the system 100 illustrated in FIG. 8. The well system 100 includes a well head apparatus 1 including at least one wellhead outlet (or second gas conduit) 8 extending from the wellhead housing 4, and at least one upper outlet (or third gas conduit) 14 extending from an eductor spool 12. An 8" blooie line connects the at least one upper outlet (or third gas conduit) 14 to a flare system 200, and within the blooie line is located a three point connector 122 and a first eductor 104. The 8" blooie line is substantially straight and substantially parallel to the ground. The three point connector is connected to a 3" choke line to the at least one wellhead outlet (or second gas conduit) 8 through choke manifold 116. The system 100 also includes three fluid compressors 110 (air compressors capable of 900 cubic feet per minute at 150 psi) configured to provide fluid to the first eductor 104 through a 2" air hose (including an air control manifold 114) to thereby provide a venturi effect. The venturi system 100 further includes a second eductor 138 positioned between the choke manifold 116 and the second gas conduit 8, and a third eductor 140 connected between the 8" blooie line and the third gas conduit 14. The fluid compressors 110 are configured to provide fluid to the second and third eductors 138, 140 (including through an air control manifold 142) to thereby provide a venturi effect. Use of three eductors 104, 138, 140 may advantageously provide improved suction, especially over longer line distances. A further outlet extends from the wellhead housing, and this outlet is connected to a mud pump 36 (capable of pumping 417 L per minute at 450 psi) and then to skid mounted storage tanks 38. The well system 100 illustrated in FIGS. 9-11 also includes a blowout preventer hydraulic power unit (BOP HPU) 40 connected to the BOP 10 in wellhead apparatus 1 and a generator 42 to power the BOP HPU 40. The flare system 200 is connected to a pump 46 (especially a 4" transfer pump capable of pumping at 1200 L per minute)) via a 4" suction hose to a skid mounted storage tank 44.

Figure 12:
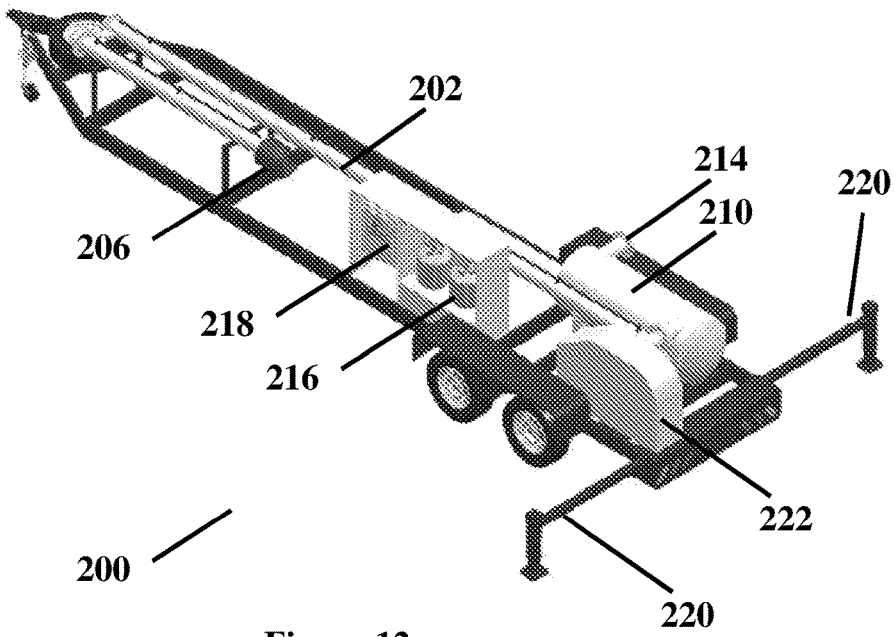
FIG. 12 provides a perspective view of an exemplary flare system, when collapsed for towing.
Figure 13:
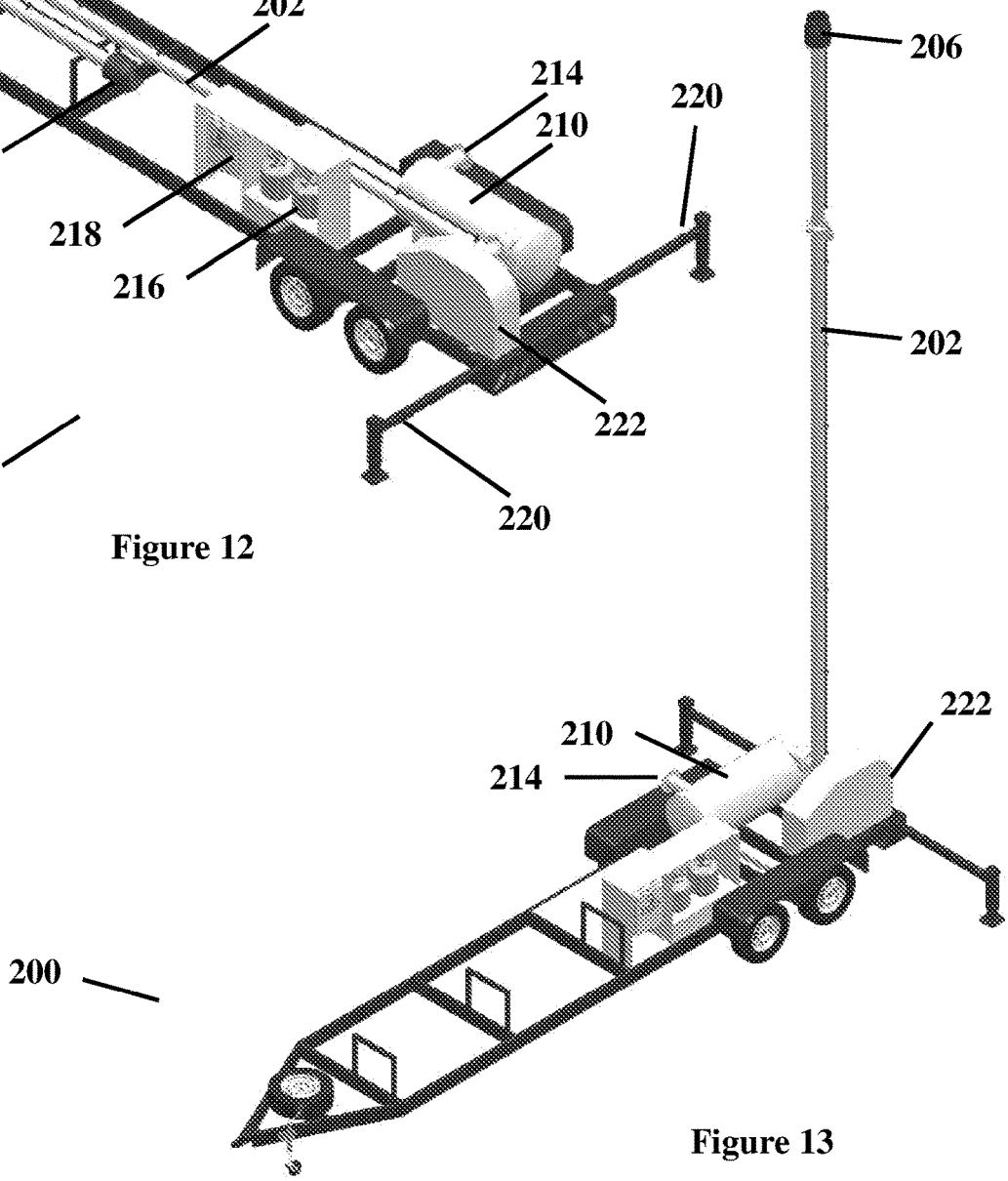
FIG. 13 provides a perspective view of the flare system of FIG. 13, as assembled.

An exemplary flare system 200 is illustrated in FIGS. 12 and 13. The flare system 200 is trailer mounted. The flare system 200 includes a knock-out drum 210 (for slowing the flow rate of gas exiting the eductor 104), flare stack 202 and flare 206. The flare system 200 also includes an inlet 214 for introduction of the gas to be flared, an igniter gas 216 for the flare, a control panel 218 and stabilizing legs 220. When assembled, the flare system 200 may be more than 10 metres high. Consequently, the system 200 may be collapsible for movement. The system 200 may include a stack elevation drive 222 for raising and lowering the flare stack.

Methods of the present invention are described below with reference to various systems described above, especially the systems 100 illustrated in FIGS. 4 and 14. However, a skilled person would readily be able to adapt the methods described below for use with systems 100 described in the other Figures.

The system 100 described in FIG. 4 may be used in performing a well operation on a component of the wellhead apparatus 1. In this method, valve 118 is closed, but valves/manifolds 114, 116 and 120 are open. The fluid compressor 110 is active and is providing fluid to the first eductor 104 to thereby provide a venturi effect. Consequently, suction is being applied to the at least one wellhead outlet (or second gas conduit) 8 (but not to the at least one upper outlet (or third gas conduit) 14 as valve 118 is closed) such that substantially all subterranean gas flows through the at least one wellhead outlet (or second gas conduit) 8. At this time, an operation on the component of the wellhead apparatus 1 may be performed (such as removing the eductor spool 12 and BOP 10).

In an alternative, the system 100 described in FIGS. 3 and 4 may be used in performing a well operation on a component of the wellhead apparatus 1. In this method, all valves/manifolds (e.g. 114, 116, 118 and 120) are open. The fluid compressor 110 is active and is providing fluid to the first eductor 104 (and to the second eductor 106 in the system of FIG. 3) to thereby provide a venturi effect. Consequently, suction is being applied to the at least one wellhead outlet (or the second gas conduit) 8 and to the at least one upper outlet (or the third gas conduit) 14 such that substantially all subterranean gas flows through the at least one wellhead outlet (or second gas conduit 8) and the at least one upper outlet (or third gas conduits 14). At this time, an operation on the component of the wellhead apparatus 1 may be performed (such as landing a hanger).

The system 100 described in FIG. 14 may be used in a method of opening a wellhead housing 4 to the atmosphere. In this method, the system 100 illustrated in FIG. 14 includes a pressure sensor for sensing the pressure in the conduit between the first eductor 104 and the at least one wellhead outlet (or second gas conduit) 8, and a pressure sensor for sensing the pressure within or adjacent to the first gas conduit 6. Furthermore, first gas conduit 6 is closed to the atmosphere at the start of this method. First, air choke manifolds 114 and 116 are closed. The wellhead housing 4 outlet valves are opened, and the pressure within or adjacent the first gas conduit 6 is noted using the sensor. If the pressure within the first gas conduit 6 exceeds the working pressure of the line connected to manifold 116, then the wellhead pressure is bled off until choke manifold 116 is fully open. Subterranean gas exiting the well bore 2 is now able to pass through the at least one wellhead outlet (or second gas conduit) 8 and to the flare system 200 via first eductor 104. Compressed air from fluid compressor 110 is then allowed to pass to first eductor 104 by opening air choke manifold 114. The pressure in the conduit between the first eductor 104 and the at least one wellhead outlet (or second gas conduit) 8 is monitored, and once the pressure reading becomes negative the flow of subterranean gas exiting the well bore 2 and entering the first gas conduit 6 is controlled, as is the flow of gas within the wellhead housing 4. At this time, the first gas conduit 6 is opened to the atmosphere (for example by removing the wellhead bonnet). A component of the wellhead apparatus 1 (such as the BOP 10) may then be installed or serviced.

A method of removing a hanger will now be described with reference to FIGS. 15 and 4. First, referring to FIG. 15. In this method, the system 100 illustrated in FIG. 15 may include a pressure sensor located at choke manifold 116, and a pressure sensor located in the first gas conduit 6, distal to the well bore 2. Furthermore, first gas conduit 6 is closed to the atmosphere at the start of this method, and a hanger is located within the wellhead apparatus 1. First, air choke manifolds 114 and 116, and in line choke 118, are closed. In line choke 120 is opened. The wellhead housing 4 outlet valves are opened, and the wellhead pressure is noted using the sensor located at choke manifold 116. If the wellhead pressure exceeds the working pressure of the line connected to manifold 116, then the wellhead pressure is bled off until choke manifold 116 is fully open. Subterranean gas exiting the well bore 2 is now able to pass through the at least one wellhead outlet (or second gas conduit) 8 and to the flare system 200 via first eductor 104. Compressed air from fluid compressor 110 is then allowed to pass to first eductor 104 by opening air choke manifold 114. The pressure reading at the pressure sensor is monitored, and once the pressure reading becomes negative the first gas conduit 6 may be opened to the atmosphere (for example by removing the wellhead bonnet). The pressure sensor in the first gas conduit 6 may be monitored during the bleed down and eductor 104 start up operations to determine whether the hanger and any associated flow control valves or penetrations are leaking. A BOP 10 may then be installed, followed by an eductor spool 12, having an outlet providing at least one upper outlet (or third gas conduit) 14. The at least one upper outlet (or third gas conduit) 14 is then connected to choke 118. The system 100 illustrated in FIG. 4 is now provided.

The hanger may now be removed from the wellhead apparatus 1. When performing this step, it is advantageous to minimise the pressure differential between the top and bottom of the hanger while ensuring the volume in the first gas conduit 6 above the eductor spool 12 is kept free of gas. If the pressure differential is too high when the hanger is pulled from its seat, then the gas velocity at that time may be high enough to pull the hanger seals from their grooves on the hanger. To minimise the exposure of the hanger seals to excessive gas velocities, the following methods may be used.

A. If no completion is attached to the hanger: (i) Remove any back pressure valve or two way check valve; (ii) Install a hanger handling joint with an in-line valve installed; (iii) Open the in-line valve, creating an air flow path through the handling tool to the at least one wellhead outlet (or second gas conduit) 8; (iv) Open the air choke 118 to create maximum suction at the at least one upper outlet (or third gas conduit) 14; (v) If possible, pull the hanger free mechanically; (vi) If the hanger is tight, it may be possible to create upward force on the bottom of the hanger by closing the in-line valve in the hanger handling tool and reducing the suction pressure at the at least one wellhead outlet (or second gas conduit) 8 (by closing the air choke 116 in a controlled manner). This should be done very carefully since the hanger may pop free creating potential for a gas vent on the workfloor or the handling tool to jumping upwards; (vii) Once the hanger is free of its seat, the in-line valve in the hanger should be closed and the air flow through the at least one wellhead outlet (or second gas conduit 8) and the at least one upper outlet (or third gas conduit) 14 should be held as close to balance as feasible; (viii) The hanger may be removed from the well at this time.

B. If a completion is attached to the hanger (i.e. a tubing string extends from the hanger into the well bore 2): (i) Closing the tubing string extending into the well bore 2; (ii) With suction being applied through the at least one wellhead outlet (or second gas conduit) 8 and the pressure below the hanger negative, install a hanger handling joint; (iii) Open air choke 118 to create maximum suction at the at least one upper outlet (or third gas conduit) 14; (iv) If possible, pull the hanger free mechanically; (v) If the hanger is tight, it may be possible to create upward force on the bottom of the hanger by reducing the suction pressure at the at least one wellhead outlet (or second gas conduit) 8 (by closing the air choke 116 in a controlled manner). This should be done very carefully since the hanger may pop free creating potential for a gas vent on the workfloor or the handling tool to jumping upwards; (vi) Once the hanger is free of its seat, the air flow through the at least one wellhead outlet (or second gas conduit) 8 and the at least one upper outlet (or third gas conduit) 14 should be held as close to balance as feasible; (vii) The hanger may be removed from the well at this time.

Figure 16:
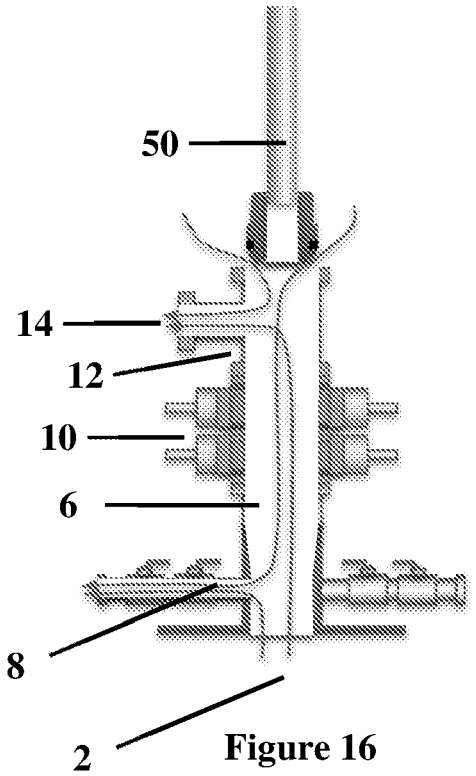
FIG. 16 provides a cross sectional view through an exemplary wellhead apparatus when landing a hanger.
Figure 17:
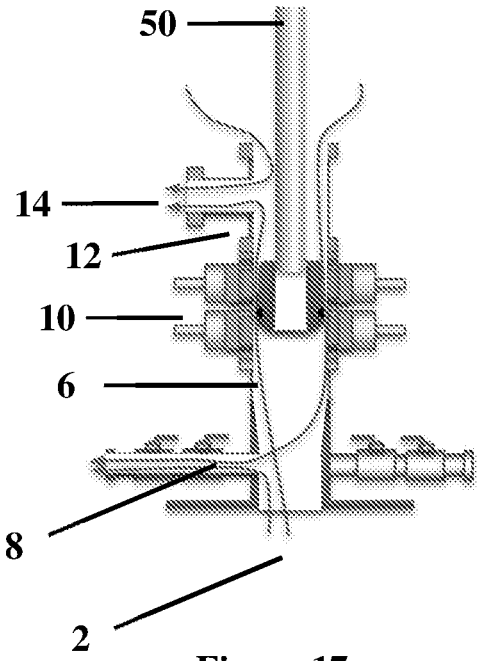
FIG. 17 provides a cross sectional view through an exemplary wellhead apparatus when landing a hanger.
Figure 18:
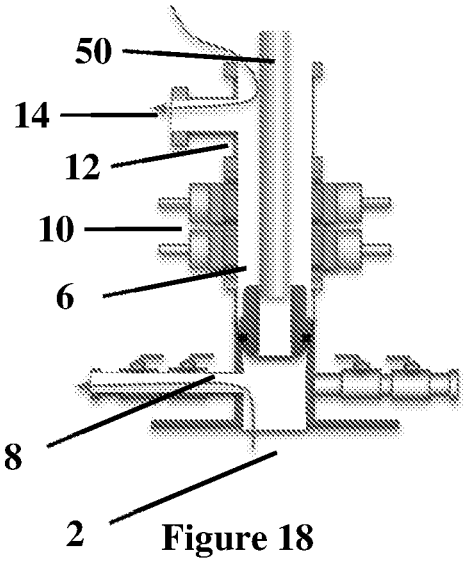
FIG. 18 provides a cross sectional view through an exemplary wellhead apparatus after the hanger has landed.

A method of landing a hanger assembly 50 will now be described with reference to FIG. 4 and with reference to FIGS. 16 to 18 (which provide a cross sectional view through the wellhead apparatus 1 illustrated in FIG. 4 as the hanger is landing). The method includes the steps of lowering the hanger assembly 50 (which includes the hanger 50 and a hanger landing tool (not shown))—see FIG. 16. Next, the suction applied at the at least one upper outlet (or third gas conduit) 14 is decreased to thereby pull the hanger assembly 50 into position with the wellhead housing 4 until substantially no suction is applied through the at least one upper outlet (or third gas conduit) 14—FIG. 17. Then the hanger assembly 50 need only be held in place—FIG. 18. After this, components such as the hanger landing tool, the eductor spool 12 and the BOP 10 may be removed from the wellhead apparatus 1. The first gas conduit may be closed to the atmosphere (such as by installing a wellhead bonnet). The venturi system 100 may also be disconnected from the wellhead housing 4.

To minimise the exposure of the hanger seals to excessive gas velocities, the following methods may be used.

A. If a completion is attached to the hanger 50 (i.e. a tubing string extends from the hanger 50 into the well bore 2): (i) Closing the tubing string extending into the wellbore 2; (ii) With suction being applied at the at least one wellhead outlet (or second gas conduit) 8 and the at least one upper outlet (or third gas conduit) 14, begin lowering the hanger into the wellhead assembly 1; (iii) The suction at the at least one wellhead outlet (or second gas conduit) 8 and the at least one upper outlet (or third gas conduit) 14 should be kept as close to balance as possible to minimize air flow across the hanger seals; (iv) With the hanger at the landing position, the suction at the at least one upper gas outlet (or third gas conduit) 14 should be reduced in a controlled manner by closing valve 118. This creates downward force on the hanger assembly 50, pulling the hanger 50 into its seat. Once seated, the hanger 50 may be locked in place (if tie down bolts are available) or held in place with suction (if a tie down bolts are not available and a lock down ring is used); (v) With the hanger in place and negative pressure at the at least one wellhead outlet (or second gas conduit) 8 confirmed, the BOP equipment may be removed and the wellhead bonnet installed; (vi) The wellhead 4 outlet valve may be closed and the suction at the at least one wellhead outlet (or second gas conduit) 8 may cease; (vii) The venturi system 100 may be disconnected from the wellhead apparatus 1.

B. If no completion is attached to the hanger assembly 50: (i) With the suction at the at least one wellhead outlet (or second gas conduit) 8 and the at least one upper outlet (or third gas conduit) 14 running and as close to balance as possible, the hanger assembly 50 (which includes a handling tool and in-line valve), is lowered into the wellhead apparatus 1. The in-line valve should be open initially, to create an air flow path that is not across the hanger seals; (ii) Once the hanger assembly 50 is at its landing position, the in-line valve is closed and the valve 118 closed in a controlled manner. This creates maximum downward force on the hanger assembly 50, ensuring the hanger assembly 50 is properly seated; (iii) The BOP 10 pipe rams are closed and a pressure test performed to verify that the hanger 50 is not leaking; (iv) The BOP 10 pipe rams are opened, the hanger in-line valve opened and the hanger handling tool removed; (v) A two way check valve is then be installed and tested using the blind rams on the BOP 10; (vi) The BOP 10 is removed and the wellhead bonnet installed; (vii) The wellhead bonnet should then be pressure tested against the two-way check valve; (viii) Once a successful pressure test is obtained, the two way check valve may be removed and replaced with a back pressure valve or left open, as per the Operator's requirements; (ix) The wellhead 4 outlet valve may be closed and the suction at the at least one wellhead outlet (or second gas conduit) 8 may cease; (x) The venturi system 100 may be disconnected from the wellhead apparatus 1.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described includes preferred forms of putting the invention into effect. The invention is, therefore, claimed in any of its forms or modifications within the proper scope of the appended claims appropriately interpreted by those skilled in the art.

The invention claimed is:

1. A method of controlling the flow of gas within a well system in gaseous communication with subterranean gas exiting a well bore, wherein the well system comprises:

a wellhead apparatus, wherein:

the wellhead apparatus defines a first gas conduit comprising a bottom end in gaseous communication with the subterranean gas exiting the well bore, and a top end distal the bottom end; wherein the first gas conduit is open to the atmosphere;

the wellhead apparatus comprises a wellhead housing at the first gas conduit bottom end, wherein the wellhead housing is connected to the well bore, wherein the wellhead housing comprises at least one wellhead housing outlet, wherein the portion of the first gas conduit defined by the wellhead housing has a second end distal the first gas conduit bottom end, and wherein the at least one wellhead housing outlet is in gaseous communication with the first gas conduit intermediate said bottom end and said second end; and the wellhead apparatus comprises at least one upper outlet in gaseous communication with the first gas conduit intermediate the at least one wellhead housing outlet and the top end;

the wellhead apparatus comprises a blowout preventer intermediate the wellhead housing and the at least one upper outlet, wherein the blowout preventer defines a portion of the first gas conduit;

at least a portion of the exterior of the blowout preventer and/or the wellhead housing is exposed to the atmosphere;

wherein the well system comprises a suction source in gaseous communication with the at least one wellhead housing outlet and the at least one upper outlet for applying suction to the at least one wellhead housing outlet and/or the at least one upper outlet to divert the flow of subterranean gas within the first gas conduit to the at least one wellhead housing outlet and/or the at least one upper outlet;

the method comprising the step of:

applying suction with the suction source to the at least one wellhead housing outlet and/or the at least one upper outlet to divert the flow of subterranean gas within the first gas conduit to the at least one wellhead housing outlet and/or the at least one upper outlet to thereby control the flow of gas within the wellhead apparatus.

2. The method of claim 1, wherein the step of applying suction to the at least one wellhead housing outlet and/or the at least one upper outlet results in substantially no subterranean gas exiting to the atmosphere via the first gas conduit top end.

3. The method of claim 1, wherein the suction is applied by a venturi system comprising at least one eductor.

4. The method of claim 3, wherein the subterranean gas is diverted to a flare system connected to the venturi system.

5. The method of claim 1, wherein the wellhead apparatus further comprises at least one spool, wherein the at least one spool defines a portion of the first gas conduit, and wherein the at least one spool comprises the at least one upper outlet, the method comprising the step of:

applying suction to the at least one wellhead housing outlet and to the at least one upper outlet to thereby divert the flow of subterranean gas within the first gas conduit to the at least one wellhead housing outlet and the at least one upper outlet to thereby control the flow of gas within the wellhead apparatus.

6. A well system comprising:

a wellhead apparatus, wherein:

the wellhead apparatus defines a first gas conduit comprising a bottom end in gaseous communication with subterranean gas exiting a well bore and a top end distal the bottom end, wherein the first gas conduit is open to the atmosphere;

the wellhead apparatus comprises a wellhead housing at the first gas conduit bottom end, wherein the wellhead housing is connected to the well bore, wherein the wellhead housing comprises at least one wellhead housing outlet, wherein the portion of the first gas conduit defined by the wellhead housing has a second end distal the first gas conduit bottom end, and wherein the at least one wellhead housing outlet is in gaseous communication with the first gas conduit intermediate said bottom end and said second end; and the wellhead apparatus comprises at least one upper outlet in gaseous communication with the first gas conduit intermediate the at least one wellhead housing outlet and the top end;

the wellhead apparatus comprises a blowout preventer intermediate the wellhead housing and the at least one upper outlet, wherein the blowout preventer defines a portion of the first gas conduit;

at least a portion of the exterior of the blowout preventer and/or the wellhead housing is exposed to the atmosphere;

a suction source in gaseous communication with the at least one wellhead housing outlet and the at least one upper outlet for applying suction to the at least one wellhead housing outlet and/or the at least one upper outlet to divert the flow of subterranean gas within the first gas conduit to the at least one wellhead housing outlet and/or the at least one upper outlet.

7. The well system of claim 6, wherein the system is configured so that substantially no subterranean gas exits to the atmosphere via the first gas conduit top end.

8. The well system of claim 6, wherein the suction source is a venturi system comprising at least one eductor.

9. The well system of claim 8, wherein the well system further comprises a flare system for receiving subterranean gas from the venturi system, wherein the flare system is in gaseous communication with the venturi system.

10. The well system of claim 9, wherein the flare system comprises a knock-out drum.

11. The well system of claim 6, wherein the wellhead apparatus further comprises at least one spool, wherein the at least one spool defines a portion of the first gas conduit, wherein the at least one spool comprises the at least one upper outlet.

12. The method of claim 1, wherein the method of controlling the flow of gas within a well system is a method of performing a well operation on a component of the well system, wherein the step of applying suction with the suction source to the at least one wellhead housing outlet and/or the at least one upper outlet is to divert the flow of gas within the first gas conduit such that substantially no subterranean gas exits to the atmosphere via the first gas conduit top end, the method further comprising the step of:

performing an operation on the component of the well system.

13. A method of opening a wellhead apparatus to the atmosphere, wherein the wellhead apparatus is part of a well system comprising:

(i) the wellhead apparatus, wherein:

the wellhead apparatus defines a first gas conduit comprising a bottom end in gaseous communication with subterranean gas exiting a well bore, and a top end distal the bottom end; wherein the first gas conduit is closed to the atmosphere;

the wellhead apparatus comprises a wellhead housing at the first gas conduit bottom end, wherein the wellhead housing is connected to the well bore, wherein the wellhead housing comprises at least one wellhead housing outlet, wherein the portion of the first gas conduit defined by the wellhead housing has a second end distal the first gas conduit bottom end, and wherein the at least one wellhead housing outlet is in gaseous communication with the first gas conduit intermediate said bottom end and said second end; and the wellhead apparatus comprises at least one upper outlet in gaseous communication with the first gas conduit intermediate the at least one wellhead housing outlet and the top end;

the wellhead apparatus comprises a blowout preventer intermediate the wellhead housing and the at least one upper outlet, wherein the blowout preventer defines a portion of the first gas conduit;

at least a portion of the exterior of the blowout preventer and/or the wellhead housing is exposed to the atmosphere;

(ii) a suction source configured to apply suction to the at least one wellhead housing outlet and/or the at least one upper outlet, and a pressure sensor for sensing the pressure within the first gas conduit;

the method further comprising the steps of:

applying suction to the at least one wellhead housing outlet and/or the at least one upper outlet;

sensing the pressure within the first gas conduit with the pressure sensor; and once the pressure sensed with the pressure sensor is negative, opening the first gas conduit to the atmosphere at a point distal to the well bore.

14. A method of removing a hanger in a well system, wherein the well system comprises:

(i) a wellhead apparatus including: a wellhead housing and a hanger, wherein the wellhead housing is in gaseous communication with subterranean gas exiting a well bore, wherein the wellhead housing is connected to the well bore, and wherein the wellhead housing comprises a first gas conduit and at least one wellhead housing outlet, wherein the first gas conduit has a first end in gaseous communication with the subterranean gas exiting the well bore and a second end distal the first end closed to the atmosphere, and the at least one wellhead housing outlet is in gaseous communication with the first gas conduit intermediate said first and second ends, wherein the hanger is positioned within the first gas conduit, and wherein at least a portion of the exterior of the wellhead housing is exposed to the atmosphere; and (ii) a suction source configured to apply suction to the at least one wellhead housing outlet, and a pressure sensor for sensing the pressure at the at least one wellhead housing outlet, wherein the method further comprises the steps of:

applying suction to the least one wellhead housing outlet;

sensing the pressure at the at least one wellhead housing outlet with the pressure sensor;

once the pressure sensed by the pressure sensor is negative, opening the first gas conduit to the atmosphere at a point distal to the well bore;

mounting a blowout preventer relative to the wellhead housing, and mounting at least one spool relative to the blowout preventer, wherein the at least one spool provides at least one upper outlet in gaseous communication with the first gas conduit;

connecting the at least one upper outlet to the suction source, and applying suction to the at least one upper outlet; and removing the hanger from the wellhead apparatus.

15. The method of claim 1, wherein the method of controlling the flow of gas within a well system is a method of landing a hanger assembly in a well system, wherein the wellhead apparatus defines a hanger landing position within the first gas conduit which is intermediate the at least one wellhead housing outlet and the at least one upper outlet; wherein the method further includes the steps of:

a. lowering a hanger assembly into the first gas conduit to its landing position, wherein the hanger assembly comprises a hanger and a hanger landing tool;

b. decreasing the suction applied at the at least one upper outlet to thereby pull the hanger assembly into position via the at least one wellhead housing outlet until substantially no suction is applied through the at least one upper outlet; and c. holding the hanger assembly in place.

16. The method of claim 3, wherein the venturi system comprises at least a first suction system and a second suction system, wherein the first suction system is configured to apply suction to the at least one wellhead housing outlet, and the second suction system is configured to apply suction to the at least one upper outlet.

17. The method of claim 16, wherein the first suction system includes at least one choke manifold for controlling a pressure differential within the system.

18. The method of claim 1, wherein the wellhead apparatus further comprises one or more of: a ball valve, a mud cross, a tubing spool, a casing spool and an eductor spool.

* * * * *